US012473912B2

(12) United States Patent
Montie et al.

(10) Patent No.: US 12,473,912 B2
(45) **Date of Patent: *Nov. 18, 2025**

(54) AXIAL LOAD IN HELICAL TROCHOIDAL ROTARY MACHINES

(71) Applicant: Rotoliptic Technologies Incorporated, Squamish (CA)

(72) Inventors: Greg John Montie, Squamish (CA); Peter Thomas Christopher Suke, Squamish (CA); Bryan Allen Callaway, Schaumburg, IL (US)

(73) Assignee: Rotoliptic Technologies Incorporated, Squamish (CA)

( * ) Notice: Subject to any disclaimer, the term of this patent is extended or adjusted under 35 U.S.C. 154(b) by 0 days.

This patent is subject to a terminal disclaimer.

(21) Appl. No.: 18/470,625

(22) Filed: Sep. 20, 2023

(65) Prior Publication Data

US 2024/0093686 A1 Mar. 21, 2024

Related U.S. Application Data

(63) Continuation of application No. 17/565,454, filed on Dec. 30, 2021, now Pat. No. 11,802,558.
(Continued)

(51) Int. Cl.
*F04C 2/107* (2006.01)
*F04C 15/00* (2006.01)

(52) U.S. Cl.
CPC ..... *F04C 2/1076* (2013.01); *F04C 15/0042* (2013.01); *F04C 15/0057* (2013.01); *F04C 15/0061* (2013.01); *F04C 2240/10* (2013.01); *F04C 2240/20* (2013.01); *F04C 2250/20* (2013.01); *F04C 2250/30* (2013.01)

(58) Field of Classification Search
CPC ..... F04C 2/1076; F04C 15/0042; F04C 15/0057; F04C 15/0061; F04C 2240/10; F04C 2240/20; F04C 2250/20; F04C 2250/30
See application file for complete search history.

(56) References Cited

U.S. PATENT DOCUMENTS 724,994 A 4/1903 Cooley
1,340,625 A 5/1920 Planche
(Continued)

FOREIGN PATENT DOCUMENTS

CA 2701474 A1 * 4/2009 ..... E21B 4/02
DE 2014499 A1 10/1971
(Continued)

OTHER PUBLICATIONS

Ansdale, R., The Wankel RC Engine, (1968), p. 20.
(Continued)

*Primary Examiner* — Mary A Davis
(74) *Attorney, Agent, or Firm* — Cook Alex Ltd.

(57) ABSTRACT

Rotary positive displacement machines based on trochoidal geometry and including a helical rotor that undergoes planetary motion relative to a helical stator can be designed and configured so that the axial load or rotor pressure force is positive, negative, or neutral. In some embodiments, a change in axial load, caused by a change in differential pressure across the machine, can be used to trigger a change in a mechanical configuration of the machine.

20 Claims, 17 Drawing Sheets

Related U.S. Application Data

(60) Provisional application No. 63/132,476, filed on Dec. 30, 2020.

(56) References Cited

U.S. PATENT DOCUMENTS 1,575,987 A 3/1926 Gilman
1,636,486 A 7/1927 Planche
1,686,569 A 10/1928 McMillan
1,738,645 A 12/1929 Gilman
1,892,217 A 12/1932 Moineau
2,612,022 A 9/1952 Keys
2,919,062 A 12/1959 Tryhorn
2,988,008 A 6/1961 Wankel
3,208,391 A 9/1965 Lindberg
3,259,113 A 7/1966 Hamada
3,279,388 A 10/1966 Roudaut
3,296,874 A 1/1967 Wyczalek
3,299,822 A 1/1967 Payne
3,302,870 A 2/1967 Schell
3,387,772 A 6/1968 Wutz
3,398,643 A 8/1968 Schudt
3,458,120 A 7/1969 Pfaff et al.
3,465,729 A 9/1969 Jones
3,512,904 A 5/1970 Allen
3,533,716 A 10/1970 Grun
3,728,049 A 4/1973 Miller
3,764,239 A 10/1973 Huf
3,822,972 A 7/1974 Ogly et al.
3,917,437 A 11/1975 Link
3,918,137 A 11/1975 Telang et al.
3,958,906 A 5/1976 Catterson et al.
3,990,817 A 11/1976 Ruf et al.
4,012,180 A 3/1977 Berkowitz et al.
4,018,548 A 4/1977 Berkowitz
4,028,021 A 6/1977 Berkowitz
4,061,445 A 12/1977 Doshi
4,118,157 A 10/1978 Mayer
4,144,001 A 3/1979 Streicher
4,182,499 A 1/1980 Kemper
4,218,199 A 8/1980 Eiermann
4,296,500 A 10/1981 Monties et al.
4,299,097 A 11/1981 Shank et al.
4,330,240 A 5/1982 Eslinger
4,382,755 A 5/1983 Hoffmann
4,395,206 A 7/1983 Hoffmann
4,397,619 A 8/1983 Aliquander et al.
4,407,639 A 10/1983 Maruyama
4,410,305 A 10/1983 Shank et al.
4,487,561 A 12/1984 Eiermann
4,504,202 A 3/1985 Saegusa
4,507,067 A 3/1985 Hansen
4,519,206 A 5/1985 Van Michaels
4,551,073 A 11/1985 Schwab
4,594,060 A 6/1986 Schwab
4,728,270 A 3/1988 Hoffmann
4,802,830 A 2/1989 Nakajima
4,934,325 A 6/1990 Snyder
5,027,653 A 7/1991 Foran
5,069,606 A 12/1991 Bachellerie
5,096,004 A 3/1992 Ide
5,127,377 A 7/1992 Yang
5,169,298 A 12/1992 Hekman et al.
5,171,138 A 12/1992 Forrest
5,295,814 A 3/1994 Uebel
5,302,096 A 4/1994 Cavalleri
5,318,415 A 6/1994 Verhoeven
5,372,107 A 12/1994 Smythe
5,379,736 A 1/1995 Anderson
5,439,359 A 8/1995 Leroy et al.
5,609,475 A 3/1997 Eiermann
5,941,305 A * 8/1999 Thrasher ..... E21B 43/121 417/18
6,074,184 A 6/2000 Imai
6,093,004 A 7/2000 Varadan et al.
6,120,267 A 9/2000 Cunningham
6,213,744 B1 4/2001 Choroszylow et al.
6,236,897 B1 5/2001 Lee et al.
6,530,357 B1 3/2003 Yaroshenko
6,718,938 B2 4/2004 Szorenyi
6,776,136 B1 8/2004 Kazempour
6,923,628 B1 8/2005 Otto
6,926,505 B2 8/2005 Sbarounis
6,974,313 B2 12/2005 Beaudoin
7,101,160 B2 9/2006 Gennami et al.
7,117,839 B2 10/2006 Horstin
7,395,805 B1 7/2008 MacMurray
7,540,728 B2 6/2009 Gorban
7,549,850 B2 6/2009 Trapalis
7,553,138 B2 6/2009 Gorban
7,726,115 B2 6/2010 Murrow et al.
7,837,451 B2 11/2010 Wiedenhoefer et al.
7,942,657 B2 5/2011 Gray
8,033,802 B2 10/2011 Tekneyan et al.
8,133,044 B2 3/2012 Wiedenhoefer et al.
8,356,585 B2 1/2013 Hathaway et al.
8,523,545 B2 9/2013 Wilbourn et al.
8,523,546 B2 9/2013 Shkolnik et al.
8,539,930 B2 9/2013 Gray
8,539,931 B1 9/2013 Hanna
8,888,474 B2 11/2014 Hohl et al.
8,905,733 B2 12/2014 Guidry
9,051,780 B2 6/2015 Trushin
9,228,590 B2 * 1/2016 Nachtergaele ..... F04C 29/0021
10,001,123 B2 6/2018 Kreuger
10,087,758 B2 10/2018 Montie et al.
10,837,444 B2 11/2020 Montie et al.
10,844,720 B2 11/2020 Montie
10,844,859 B2 11/2020 Montie et al.
11,286,928 B2 * 3/2022 Krampe ..... F04C 2/1073
11,499,550 B2 11/2022 Montie et al.
11,802,558 B2 10/2023 Montie et al.
11,815,094 B2 11/2023 Montie et al.
2002/0122722 A1 9/2002 Bertin et al.
2003/0102629 A1 6/2003 Bhate et al.
2005/0017053 A1 1/2005 Sbarounis
2006/0073032 A1 4/2006 Parrett
2006/0127259 A1 6/2006 Gorban
2006/0233653 A1 10/2006 Trapalis
2008/0031758 A1 2/2008 Rosam et al.
2008/0193309 A1 8/2008 Kothnur et al.
2009/0110579 A1 4/2009 Amburgey
2009/0220369 A1 9/2009 Wiedenhoefer et al.
2009/0241536 A1 10/2009 Gale et al.
2010/0183454 A1 7/2010 Lübke et al.
2011/0150685 A1 6/2011 Wilbourn et al.
2011/0262291 A1 10/2011 Fleger et al.
2012/0070326 A1 3/2012 Hammerbeck
2012/0156078 A1 6/2012 Guidry
2012/0177484 A1 7/2012 Lusted et al.
2012/0240885 A1 9/2012 Horn
2013/0028775 A1 1/2013 Gekht et al.
2013/0064702 A1 3/2013 Hohl et al.
2014/0170011 A1 6/2014 Clouzeau et al.
2014/0286808 A1 9/2014 Kachele
2015/0030492 A1 1/2015 Montie et al.
2016/0017711 A1 1/2016 Morris
2016/0141921 A1 5/2016 Kubes
2017/0074100 A1 3/2017 Jarvis et al.
2017/0137005 A1 5/2017 Weh et al.
2017/0321697 A1 11/2017 Beinert et al.
2018/0291740 A1 10/2018 Montie
2018/0291900 A1 10/2018 Valkenberg et al.
2020/0200008 A1 6/2020 Montie et al.
2020/0200174 A1 6/2020 Montie et al.
2021/0025392 A1 1/2021 Montie et al.
2021/0062655 A1 3/2021 Montie et al.
2021/0189880 A1 6/2021 Montie et al.
2021/0199011 A1 7/2021 Montie et al.
2021/0285440 A1 9/2021 Montie et al.
2022/0205445 A1 6/2022 Montie et al.

(56) References Cited

U.S. PATENT DOCUMENTS

| | | | |
|---|---|---|---|
| 2022/0220958 | A1 | 7/2022 | Montie et al. |
| 2023/0098259 | A1 | 3/2023 | Montie et al. |

FOREIGN PATENT DOCUMENTS

| | | | |
|---|---|---|---|
| EP | 1552124 | A1 | 5/2006 |
| EP | 1988288 | B1 | 11/2008 |
| GB | 1542366 | A | 3/1979 |
| JP | H1010141265 | A1 | 5/1998 |
| JP | H275663124 | B1 | 2/2015 |
| PL | 173668 | B1 | 7/1994 |
| WO | 1993022631 | A1 | 11/1993 |
| WO | 1999056004 | A1 | 11/1999 |
| WO | 2005078239 | A1 | 8/2005 |
| WO | 2009103528 | A2 | 10/2009 |
| WO | 2010131103 | A2 | 3/2011 |
| WO | 2018222490 | A1 | 2/2018 |

OTHER PUBLICATIONS

Wydra, L., The Development of Outer-Envelope Trochoidal Compressors, International Compressor Engineering Conference (1986), pp. 282-292.

Wrede et al., Recent Status of Trochoidal Type Compressors for Heat Pumps in Germany, International Compressor Engineering Conference (1986), pp. 254-282.

International Search Report and Written Opinion dated Nov. 13, 2019 issued in connection with International Application No. PCT/CA2019/051273.

International Search Report and Written Opinion dated Nov. 18, 2019 issued in connection with International Application No. PCT/CA2019/051274.

International Search Report and Written Opinion dated Nov. 19, 2019 issued in connection with International Application No. PCT/CA2019/051272.

International Preliminary Report on Patentability dated Mar. 9, 2021 issued in connection with International Application No. PCT/CA2019/051272.

International Preliminary Report on Patentability dated Mar. 9, 2021 issued in connection with International Application No. PCT/CA2019/051273.

International Preliminary Report on Patentability dated Mar. 9, 2021 issued in connection with International Application No. PCT/CA2019/051274.

UK Examination Report dated Mar. 1, 2022 issued in connection with Great Britain Application No. GB 2104634.7.

International Search Report and Written Opinion dated Mar. 29, 2022, issued in connection with International Application No. PCT/CA2022/050021.

Extended European Search Report issued on May 16, 2022 in connection with European Patent Application 19859949.0.

Extended European Search Report issued on Jul. 8, 2022, in connection with European Patent Application 19860104.9.

UK Examination Report dated Oct. 21, 2022, issued in connection with Great Britain Application No. GB 2104634.7.

UK Examination Report dated Jan. 19, 2023, issued in connection with Great Britain Application No. GB 2104634.7.

International Preliminary Report on Patentability issued in connection with PCT Application PCT/CA2022/050021.

Examiner's Report issue Feb. 7, 2024, in connection with Canadian Application No. 3177204.

Examiner's Report issued Feb. 15, 2024, in connection with Canadian Application No. 3112348.

Om et al., Calculation for Cross Section and Area Efficiency of Progressing Cavity Pump with Hypotrochoidal Multilobe Using the Differential Geometric Envelope Approach Journal of Petroleum Science and Engineering, Elsevier, Amsterdam, NL, vol. 171, Apr. 1, 2018, pp. 211-217.

Examiner's Report issued Aug. 9, 2024, in connection with European Patent Application 19859949.0.

Examiner's Report issued Sep. 16, 2024, in connection with European Patent Application No. 19860104.9.

Office Action issued Nov. 22, 2024, in connection with Canadian Patent Application No. 3,112,348.

Office Action issued Jan. 27, 2025, in connection with Canadian Patent Application No. 3,177,204.

Examiner's Report issued Jan. 31, 2025, in connection with European Patent Application No. 19859949.0.

* cited by examiner

AXIAL LOAD IN HELICAL TROCHOIDAL ROTARY MACHINES

CROSS-REFERENCE TO RELATED APPLICATIONS

This application is a continuation of U.S. patent application Ser. No. 17/565,454 filed Dec. 30, 2021, and entitled "Axial Load In Helical Trochoidal Rotary Machines". 'The '454 application is related to and claims priority benefits from U.S. Provisional Patent Application Ser. No. 63/132,476 filed Dec. 30, 2020, also entitled "Axial Load In Helical Trochoidal Rotary Machines". This application also claims priority benefits from the '476 application. The '454 and '476 applications are hereby incorporated by reference herein in their entireties.

FIELD OF THE INVENTION

The present invention relates to adjustment or control of axial load in rotary positive displacement machines, where the machines are based on trochoidal geometry. In at least some embodiments, the machines comprise a helical rotor that undergoes planetary motion relative to a helical stator.

Rotary machines, in which at least one rotor has planetary motion within a stator or housing, can be employed, for example, as positive displacement pumps, rotary compressors, vacuum pumps, expansion engines, and the like.

Pumps are devices that can move a working fluid from one place to another. There is a wide range of end uses for various types of pumps, including irrigation, fire-fighting, flood control, water supply, gasoline supply, refrigeration, chemical movement and sewage transfer. Rotary pumps are typically positive displacement pumps comprising a fixed housing, gears, cams, rotors, vanes and/or similar elements. Rotary pumps usually have close running clearances (only a small distance or gap between their moving and stationary parts), do not require suction or discharge valves, and are often lubricated only by the fluid being pumped.

A positive displacement pump moves fluid by trapping a volume of fluid in a chamber and forcing the trapped volume into a discharge pipe. Some positive displacement pumps employ an expanding chamber on the suction side and a decreasing chamber on the discharge side. Fluid flows into the pump intake as the chamber on the suction side expands, and the fluid flows out of the discharge pipe as the chamber collapses. The output volume is the same for each cycle of operation. An ideal positive displacement pump can produce the same flow rate at a given pump speed regardless of the discharge pressure.

Various classes of rotary machines based on trochoidal geometries are known. Such rotary machines comprise a rotor or stator whose cross-section is bounded by a certain family of curves, known as trochoids or trochoidal shapes. These include machines with the following configurations:

(1) rotary machines in which the rotor is hypotrochoidal in cross-section, and undergoes planetary motion (spins about its axis and orbits eccentrically) within a stator that is shaped as an outer envelope of that rotor (with the rotor having one more apex or lobe than the stator cavity);

(2) rotary machines in which the stator cavity is hypotrochoidal in cross-section, and the rotor undergoes planetary motion within the stator and is shaped as the inner envelope of that stator (with the rotor having one less apex or lobe than the stator cavity);

(3) rotary machines in which the rotor is epitrochoidal in cross-section, and undergoes planetary motion within a stator that is shaped as an outer envelope of that rotor (with the rotor having one less apex or lobe than the stator cavity); and (4) rotary machines in which the stator cavity is epitrochoidal in cross-section, and the rotor undergoes planetary motion within the stator and is shaped as the inner envelope of that stator (with the rotor having one more apex or lobe than the stator cavity).

Thus, in all of these configurations, the rotor or stator is a trochoidal component, meaning it has a cross-sectional shape that is a trochoid.

Generally, as used herein, an object is said to undergo "planetary motion" when it spins about one axis and orbits about another axis.

Rotary machines, such as those described above, can be designed for various applications including, for example, as pumps, compressors, and expansion engines. The design, configuration and operation of different rotary machines can offer particular advantages for certain applications.

Progressive cavity pumps (PCPs) are another type of rotary positive displacement machine that can offer advantages for certain applications. In PCPs, a rotor is disposed and rotates eccentrically within a helical stator cavity. The material to be pumped (typically a fluid) follows a helical path along the pump axis. The rotor is typically formed of rigid material and the stator (or stator lining) of resilient or elastomeric material. The rotor is typically helical with a circular transverse cross-section displaced from the axis of the helix and defines a single-start thread. The corresponding stator cavity is a double helix (two-start thread) with the same thread direction as the rotor, and in transverse cross-section has an outline defined by a pair of spaced apart semi-circular ends joined by a pair of parallel sides. The pitch (the axial distance between adjacent threads) of the stator is the same as the pitch of the rotor, and the lead of the stator (the axial distance or advance for one complete turn) is twice that of the rotor.

In PCPs, the rotor generally seals tightly against the elastomeric stator as it rotates within it, forming a series of discrete fixed-shape, constant-volume chambers between the rotor and stator. The fluid is moved along the length of the pump within the chambers as the rotor turns relative to the stator. The volumetric flow rate is proportional to the rotation rate. The discrete chambers taper down toward their ends and overlap with their neighbors, so that the flow area is substantially constant and in general, there is little or no flow pulsation caused by the arrival of chambers at the outlet. The shear rates are also typically low in PCPs in comparison to those in other types of pumps. In PCPs, where the rotor touches the stator, the contacting surfaces are generally traveling transversely relative to one another, so small areas of sliding contact occur.

Force loads are created as a result of fluid pressure acting on surfaces within pumps or other rotary machines. The loads are typically expressed in terms of the radial and axial orientation of the rotating components of the machines. The forces can be excessive. In some cases they can be mitigated by configuring the components of the rotary machine such that the forces are more balanced within the device, however this is not always possible.

SUMMARY OF THE INVENTION

In a first set of embodiments, a helical trochoidal rotary machine comprises a stator and a rotor disposed within the stator, the rotor having a rotor helical profile and a rotor axis, the stator having a stator helical profile and a stator axis, and/or the rotary machine has an eccentricity ratio between approximately 0.1 and 0.65.

In a second set of embodiments, a helical trochoidal rotary machine comprises a stator and a rotor disposed within the stator, the rotor having a rotor helical profile and a rotor axis, the rotor configured to spin about the rotor axis, the stator having a stator helical profile and a stator axis, the stator configured to spin about the stator axis. The rotor and stator are held at a fixed eccentricity with the rotor axis offset relative to the stator axis so that during operation of the rotary machine, the rotor undergoes planetary motion relative to the stator without orbiting. The rotary machine has an eccentricity ratio between approximately 0.1 and 0.65. In some embodiments of such helical trochoidal rotary machines, the rotor is coupled to a drive system to spin the rotor about the rotor axis, and the rotary machine is configured so that spinning of the rotor causes the stator to spin about the stator axis. In some embodiments, the stator is coupled to a drive system to spin the stator about the stator axis, and the rotary machine is configured so that spinning of the stator causes the rotor to spin about the rotor axis.

In some embodiments of helical trochoidal rotary machines, such as the first and second sets of embodiments discussed above, the rotor has a hypotrochoidal shape at any cross-section transverse to the rotor axis, along at least a portion of a length of the rotor, and the rotor is configured to undergo planetary motion within the stator, and the stator has a shape at any cross-section transverse to the stator axis along at least a portion of a length of the stator that is an outer envelope formed when the hypotrochoidal shape of the rotor undergoes planetary motion. The hypotrochoidal shape of the rotor can have n lobes where n is an integer, the outer envelope shape of the stator can have (n−1) lobes, the pitch of the rotor can be the same as the pitch of the stator, and the ratio of the lead of the rotor to the lead of the stator can be n:(n−1). In some embodiments, the hypotrochoidal rotor shape is an ellipse, and n=2, wherein the pitch of the rotor is the same as the pitch of the stator, and the ratio of the lead of the rotor to the lead of the stator is 2:1.

In some embodiments of helical trochoidal rotary machines, such as the first and second sets of embodiments discussed above, the rotor has a rotor shape that is inwardly offset from a hypotrochoidal shape at any cross-section transverse to the rotor axis, along at least a portion of a length of the rotor, the rotor configured to undergo planetary motion within the stator, and the stator has a stator shape at any cross-section transverse to the stator axis along at least a portion of a length of the stator that is an outer envelope formed when the rotor shape undergoes planetary motion. The hypotrochoidal shape of the rotor can have n lobes where n is an integer, the outer envelope shape of the stator can have (n−1) lobes, the pitch of the rotor can be the same as the pitch of the stator, and the ratio of the lead of the rotor to the lead of the stator can be n:(n−1). In some embodiments, the hypotrochoidal shape is an ellipse, and n=2, wherein the pitch of the rotor is the same as the pitch of the stator, and the ratio of the lead of the rotor to the lead of the stator is 2:1.

In some embodiments of helical trochoidal rotary machines, such as the first and second sets of embodiments discussed above, the stator has an epitrochoidal shape at any cross-section transverse to the stator axis, along at least a portion of a length of the stator, and the rotor is configured to undergo planetary motion within the stator, and the rotor has shape at any cross-section transverse to the rotor axis, along at least a portion of a length of the rotor, that is an inner envelope formed when the epitrochoidal shape of the stator undergoes planetary motion. The epitrochoidal shape of the stator can have n−1 lobes where n is an integer, the inner envelope shape of the rotor can have n lobes, the pitch of the rotor can be the same as the pitch of the stator, and the ratio of the lead of the rotor to the lead of the stator can be n:(n−1). In some embodiments, n=2, the pitch of the rotor is the same as the pitch of the stator, and the ratio of the lead of the rotor to the lead of the stator is 2:1.

In some embodiments of helical trochoidal rotary machines such as the first and second sets of embodiments discussed above, the stator has a stator shape that is outwardly offset from an epitrochoidal shape at any cross-section transverse to the stator axis, along at least a portion of a length of the stator, and the rotor is configured to undergo planetary motion within the stator, and the rotor has a rotor shape at any cross-section transverse to the rotor axis, along at least a portion of a length of the rotor, that is an inner envelope formed when the stator shape undergoes planetary motion. The epitrochoidal shape of the stator can have n−1 lobes where n is an integer, the inner envelope shape of the rotor can have n lobes, the pitch of the rotor can be the same as the pitch of the stator, and the ratio of the lead of the rotor to the lead of the stator can be n:(n−1). In some embodiments n=2, the pitch of the rotor is the same as the pitch of the stator, and the ratio of the lead of the rotor to the lead of the stator is 2:1.

In a third set of embodiments, a helical trochoidal rotary machine is a pump comprising a stator and a rotor disposed within the stator, the rotor having a rotor helical profile and a rotor axis, the stator having a stator helical profile and a stator axis, and the rotary machine has an eccentricity ratio selected so that the axial load is near-zero during operation of the pump to pump a fluid.

In a fourth set of embodiments, a helical trochoidal rotary machine is a pump comprising a stator and a rotor disposed within the stator, the rotor having a rotor helical profile and a rotor axis, the stator having a stator helical profile and a stator axis, and during operation of the pump the axial load varies with differential pressure and, at a differential pressure threshold, the axial load triggers a change in a mechanical configuration of the machine. Some embodiments are configured so that a change in axial load changes a gear ratio that is used to drive the machine, for example, via a continuously variable transmission. Some embodiments are configured so that a change in axial load causes a change in gear ratio. Some embodiments are configured so that a change in axial load causes a different section of the machine to be used.

A method of operating a helical trochoidal rotary machine, wherein the helical trochoidal rotary machine is a pump, comprises reducing the axial load on the pump by increasing the pressure differential across the pump during operation of the pump to pump a fluid.

DETAILED DESCRIPTION OF ILLUSTRATIVE EMBODIMENT(S)

Figure 1A:
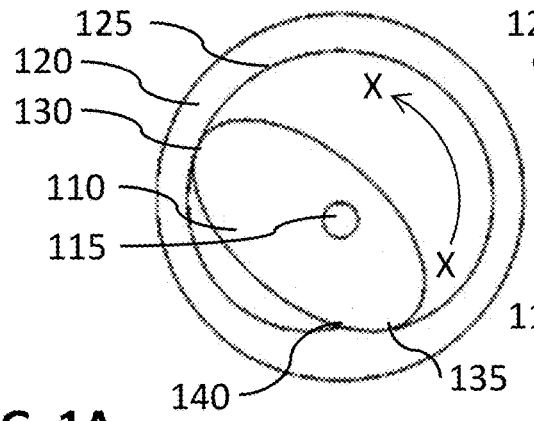
FIGS. 1A-1F (Prior Art) are schematic diagrams illustrating, in transverse cross-section, the geometry of an elliptical rotor and stator assembly at different stages of a single revolution of the elliptical rotor.
Figure 1B:
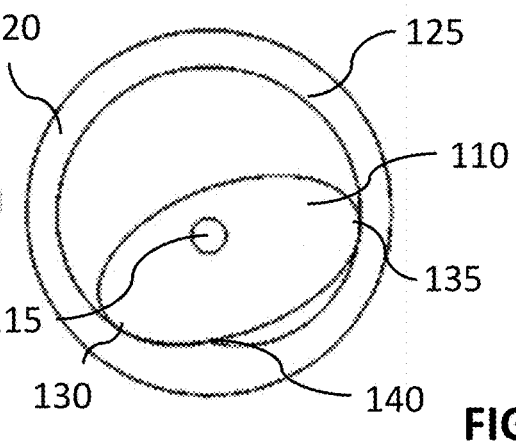
Figure 1C:
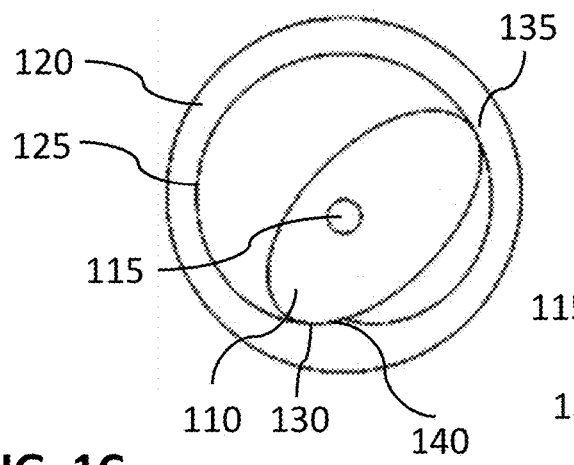
Figure 1D:
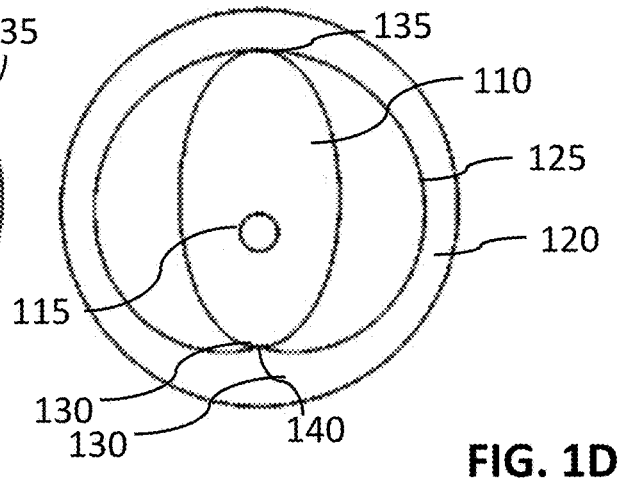
Figure 1E:
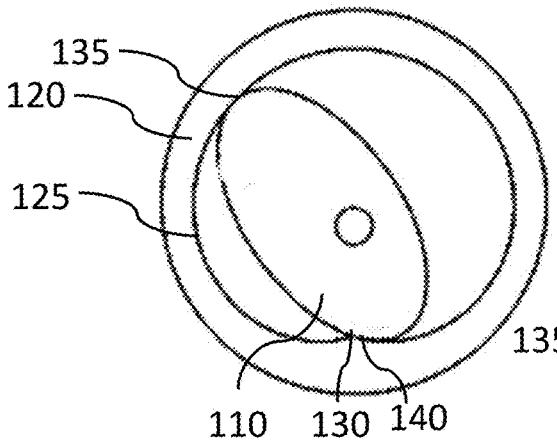
Figure 1F:
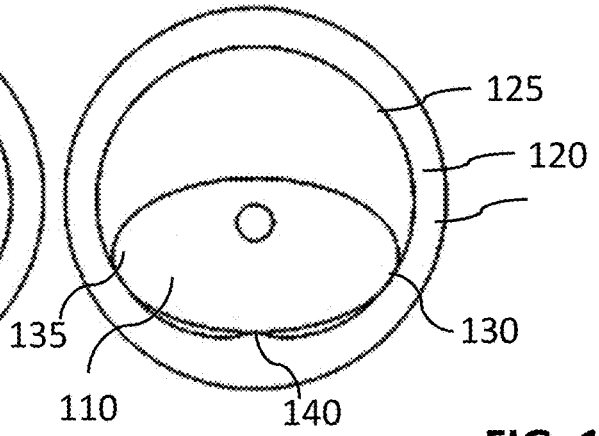
FIG. 1F Prior Art

The present disclosure relates to, among other things, rotary machines in which a helical rotor undergoes planetary motion relative to a stator. As used herein the term "stator" refers to an outer member, within which a rotor can be disposed, and is not limited to a stationary component of a rotary machine. In some embodiments of the rotary machines described herein, the outer member is configured to be stationary during operation of the rotary machine, for example as a fixed stator. In some embodiments of the rotary machines described herein, the outer member is configured to move during operation of the rotary machine. For example, in some embodiments the outer member may spin about its axis or undergo planetary motion about a rotor. The rotary machines described herein are based on trochoidal geometries, with the rotor or stator having a trochoidal geometry (in transverse cross-section, i.e. perpendicular to its axis). In some embodiments, the stator cavity can have an epitrochoidal cross-sectional geometry with the corresponding rotor cross-sectional profile being the inner envelope formed by the trochoid as it undergoes planetary motion (with the rotor having one more apex or lobe than the stator cavity). Much of the description below is focused on embodiments in which the rotor has a hypotrochoidal cross-sectional shape, with the corresponding stator cavity profile being the outer envelope of the rotor as it undergoes planetary motion (with the rotor having one more apex or lobe than the stator cavity). In at least some of these embodiments, one or more specific points on the envelope (whether it be the rotor or the stator) is in continuous contact with the corresponding component, and the contact point traces a trochoidal profile as the components execute their relative motion.

In some embodiments, the hypotrochoid and outer envelope (rotor and stator transverse cross-sectional profiles, respectively) are each swept along helical paths, the axes of those helices being the axes of rotation of those components in a reference frame in which both parts undergo simple rotary motion (the "centers" of those components). In some embodiments, the axes of the rotor and stator helices are offset from one another by a distance equal to the eccentricity of the rotor. In some embodiments, the helical rotor and corresponding stator have the same pitch, and the ratio of the lead of the rotor to the lead of the stator is the same as the ratio of their number of lobes (which is also the same as the ratio of their number of starts). As used herein, "pitch"

is defined as the axial distance between adjacent threads (or crests or roots, for example, on a helix), and "lead" is defined as the axial distance or advance for one complete turn (360°). Pitch and lead are equal with single start helices; for multiple start helices the lead is the pitch multiplied by the number of starts.

In some embodiments of the rotary machines, the stator cross-sectional shape has n−1 lobes, where n is an integer greater than 1, the rotor shape has n lobes, the pitch of the rotor is the same as the pitch of the stator, and the ratio of the lead of the rotor to the lead of the stator is n:(n−1). In some embodiments where n=2, the pitch of the rotor is the same as the pitch of the stator, and the ratio of the lead of the rotor to the lead of the stator is 2:1.

Thus, in some embodiments the outer surface of a helical rotor is defined by an ellipse swept along a helical path, and a corresponding stator cavity is defined by sweeping the corresponding outer envelope along a helical path with half the lead of the helical rotor. The rotor profile is a double-start helix, and the stator profile is a single-start helical cavity. For such a machine, when a transverse cross-section is taken in any plane perpendicular to the axis of rotation (of the rotor and/or stator), the outer profile of the rotor and inner profile of the stator (that is, the cross-sectional shape of the rotor and stator, respectively) is similar to those illustrated for those components in FIGS. 1A-1F in which rotor 110 and stator 120 are shown at different points in time during a single revolution of the rotor within the stator. Stator inner surface 125 comprises an inverse apex 140. A portion of each of rotor tips 130 and 135 is in contact with inner surface 125 of stator 120, and outer surface of rotor 110 is in contact with inverse apex 140. Rotor 110 spins about its longitudinal axis and rotates eccentrically in the direction indicated by arrow X-X (counter-clockwise) about axis 115.

Figure 2A:
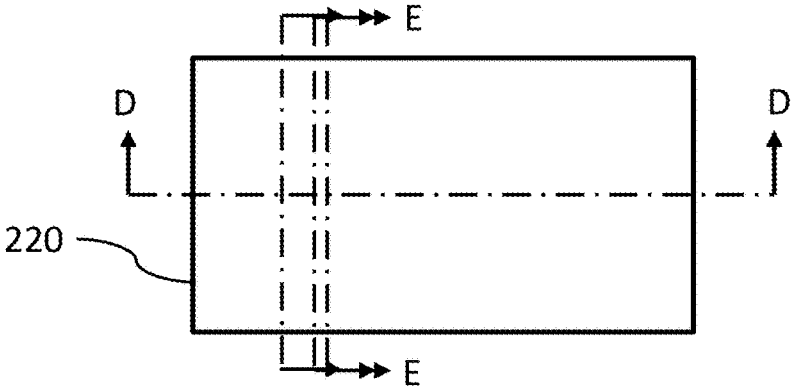
FIG. 2A shows a side view of a rotor-stator assembly showing an outer cylindrical surface of the stator.
Figure 2B:
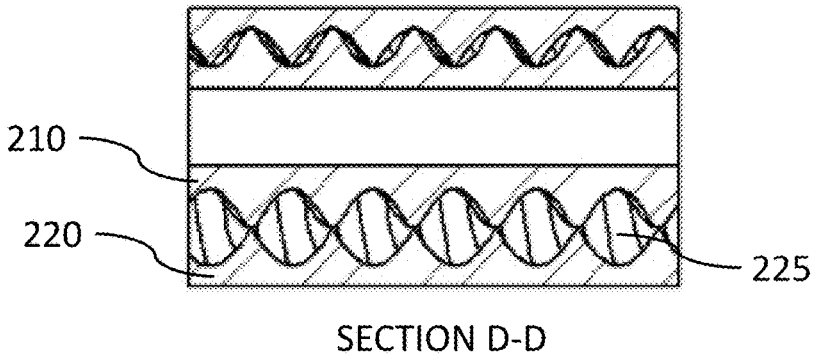
FIG. 2B is a cross-sectional view of the rotor-stator assembly of FIG. 2A, taken in the direction of arrows D-D, showing a helical rotor disposed within a helical stator cavity.
Figure 2C:
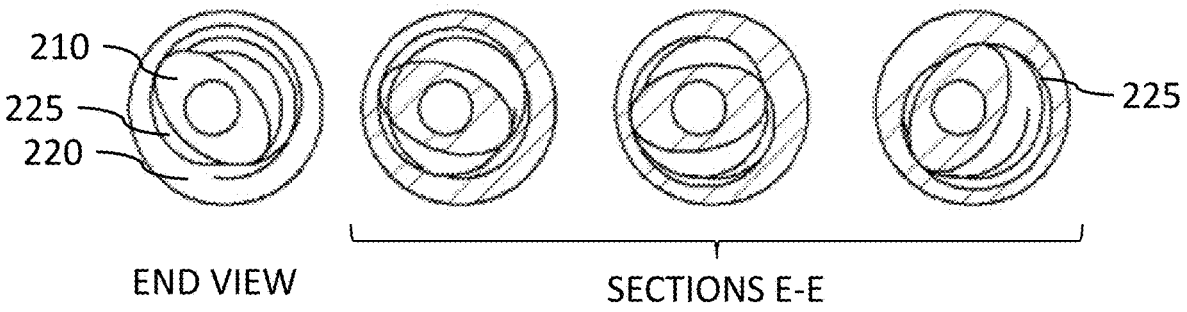
FIG. 2C shows an end view and three cross-sectional views taken in the direction of arrows E-E in FIG. 2A, showing the helical rotor with a two-lobe, elliptical transverse cross-section.

FIGS. 2A-C illustrate another example of such a rotary machine. FIG. 2A shows a side view of a stator 220. The exterior surface of stator 220 is cylindrical. FIG. 2B is a cross-sectional view taken in the direction of arrows D-D in FIG. 2A, and shows helical rotor 210 disposed within helical stator cavity 225 defined by stator 220. FIG. 2C shows an end view and various cross-sectional views taken in the direction of arrows E-E in FIG. 2A. Rotor 210 has an elliptical transverse cross-section, as shown in FIG. 2C. As the cross-section E-E progresses along the axis of rotation of rotor 210, the cross-sectional profile of the rotor and stator progresses in a manner analogous to the motion over time of rotor 110 within stator 120, as illustrated in FIGS. 1A-1G. In the embodiment illustrated in FIGS. 2A-2C, rotor 210 has two lobes and stator cavity 225 has one lobe.

Figure 3A:
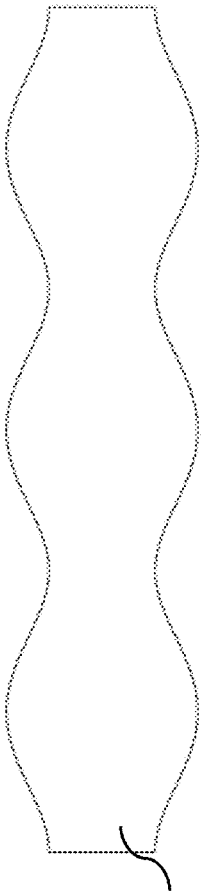
FIG. 3A is a side view of a helical rotor with an elliptical transverse cross-section.
Figure 3B:
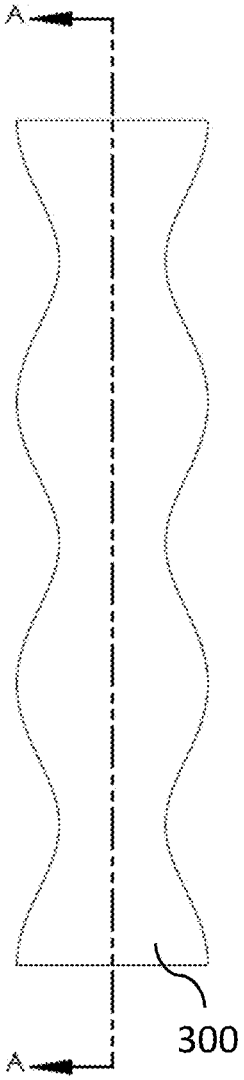
FIG. 3B is another side view of the helical rotor of FIG. 3A, orthogonal to the view of FIG. 3A.
Figure 3C:
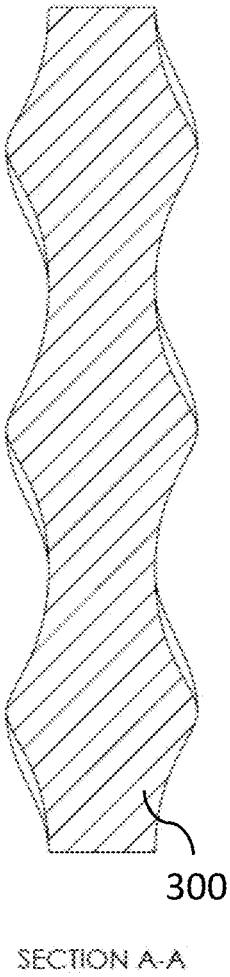
FIG. 3C is a cross-sectional view of the helical rotor of FIG. 3A taken in the direction of arrows A-A in FIG. 3B.

FIG. 3A is a side view of helical rotor 300 (with an elliptical transverse cross-section) similar to rotor 210 of FIGS. 2A-C. FIG. 3B is another side view of helical rotor 300, orthogonal to the view of FIG. 3A. FIG. 3C shows a cross-sectional view of rotor 300 taken in the direction of arrows A-A in FIG. 3B.

Figure 4A:
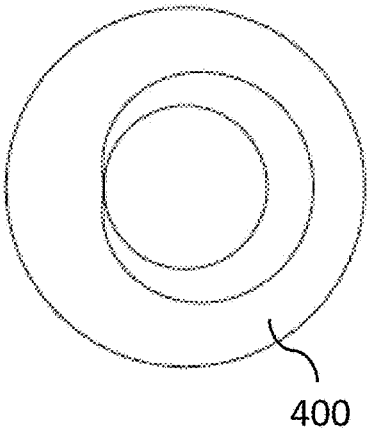
FIG. 4A is an end view of a stator with a helical cavity.
Figure 4B:
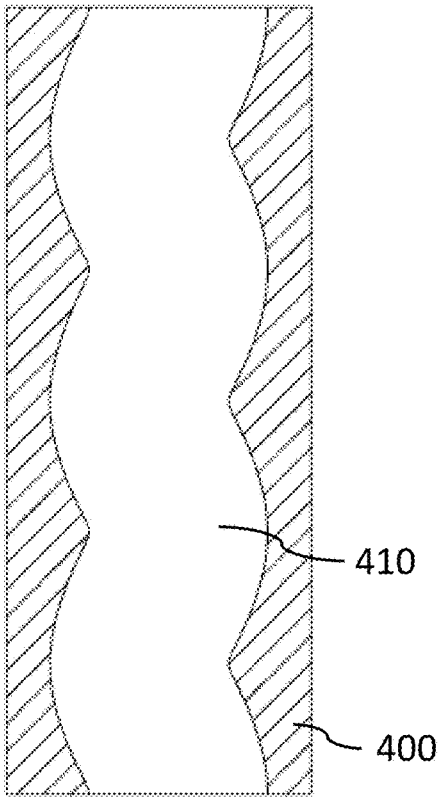
FIG. 4B is a transverse cross-sectional view of the stator of FIG. 4A.
Figure 4C:
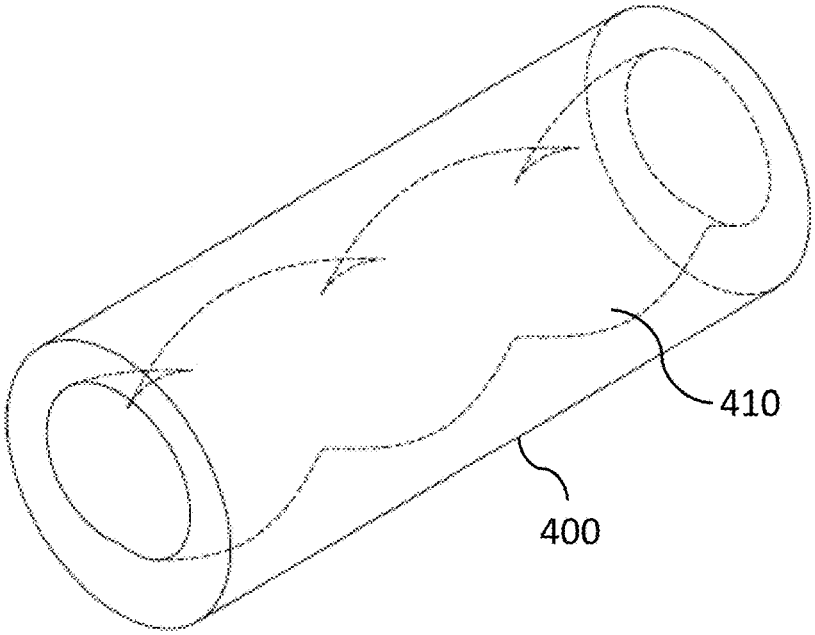
FIG. 4C is an isometric view of the stator of FIG. 4A (with the dashed line indicating the stator cavity).

FIG. 4A is an end view, FIG. 4B is a cross-sectional view and FIG. 4C is an isometric view of stator 400 having helical stator cavity 410 (with the dashed line in FIG. 4C indicating helical stator cavity). Stator 400 corresponds to rotor 300 of FIGS. 3A-C (in other words stator 400 can be used with rotor 300), and is similar to stator 220 of FIGS. 2A-C.

Figure 5:
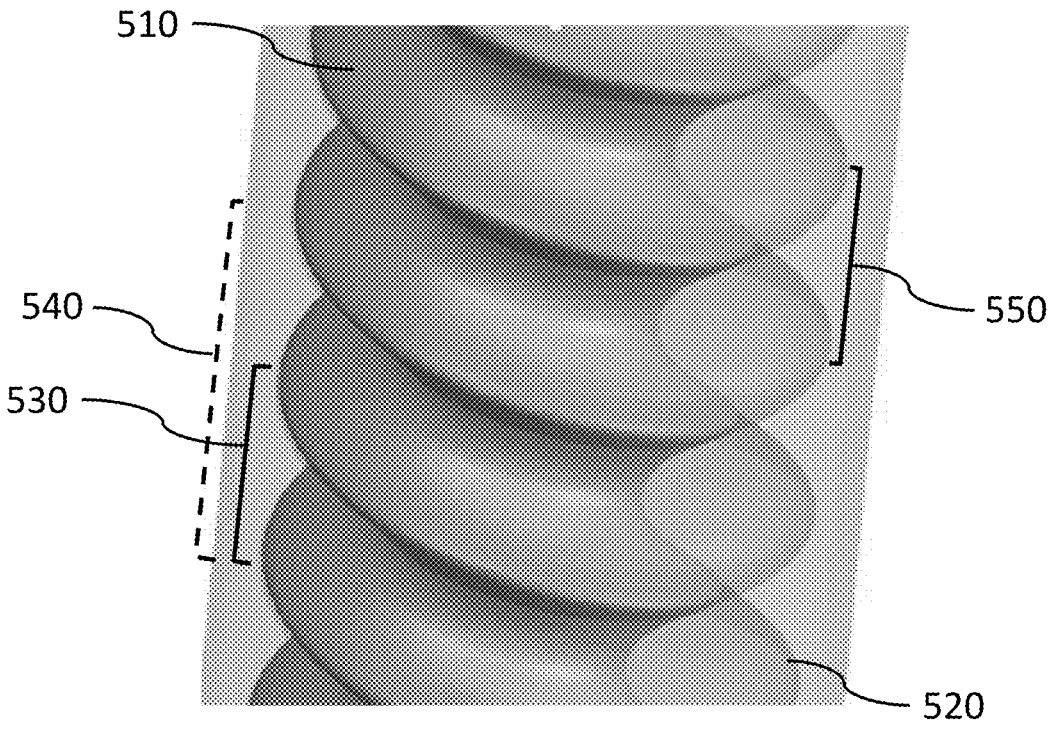
FIG. 5 illustrates a portion of a rotor-stator assembly, showing a helical rotor disposed inside a translucent helical stator.

FIG. 5 illustrates an example of a portion of a machine such as illustrated in FIGS. 2A-2C, showing helical rotor 510 disposed inside translucent helical stator 520. The pitch of the rotor (distance between adjacent threads or crests) is indicated by distance 530, and the lead of the rotor is indicated by distance 540. Because the rotor is a double-start helix, the lead is twice the pitch. The pitch of the stator is indicated by distance 550 and, because the stator is a single-start helix, distance 550 is also the lead of the stator. In the embodiment illustrated in FIG. 5, the pitch of the rotor (distance 530) and the pitch of the stator (distance 550) are the same.

In at least some embodiments, there is a quasi-helical contact path between the rotor and the inner "ridge" (or crest) of the stator at all times during rotation of the rotor relative to the stator. The contact path with the stator moves or oscillates back and forth across the helical "ridge" or crest of the rotor as the rotor rotates relative to the stator. The rotor-stator contact path revolves around the machine as pumping action proceeds, "threading" the fluid (or material to be pumped) in a spiral path along the helix, to that it is moved axially from one end of the stator cavity to the other.

The working principal of the rotary machines described herein is independent of which component of the machine is "fixed" and which is rotating. In some embodiments, for example, the machine can be operated such that the stator is fixed and the rotor spins and undergoes planetary motion (orbits) within it. This configuration is mechanically simple and compact, but sometimes requires counterweights to provide balance. In other embodiments, the outer stator undergoes planetary motion about the inner rotor.

Some embodiments of the rotary machines are operated such that the rotor spins, but does not orbit. For example, in some embodiments the rotor spins but can be held at a specific eccentricity relative to the stator, and the stator can also be allowed to spin, so that the rotor and stator each revolve around their respective longitudinal axes. In such embodiments, even though the rotor and stator are each spinning (i.e. rotating) about their respective longitudinal axes, the relative motion of the components is basically the same as in corresponding fixed stator embodiments where the rotor spins and orbits within the stator.

In at least some embodiments, holding the rotor and stator at a fixed eccentricity and having these components spin about their longitudinal axes, rather than having one of them orbit, can significantly reduce problems with vibration and make the machine more balanced in operation.

With such rotary machine designs, one approach is to drive the rotor, for example by coupling it to a motor via a drive shaft, and allowing the rotation of the rotor to drive the rotation of the stator. In other embodiments, the stator could be driven instead of the rotor. In another approach, the eccentricity is still fixed, but instead of the rotor driving the stator (or vice versa), a gear set is used and both the rotor and the stator are driven via gears.

Figure 6:
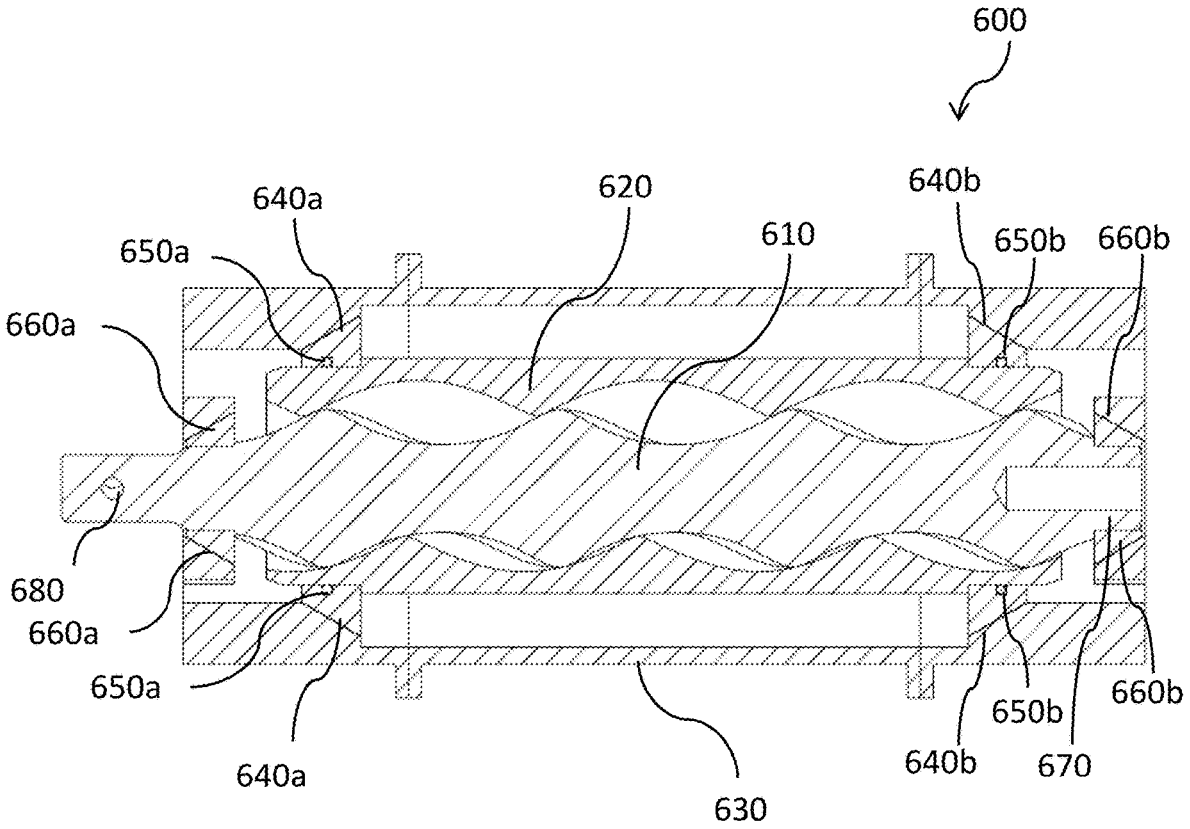
FIG. 6 is a cross sectional view of an embodiment of a fixed-eccentricity rotary machine assembly with a helical rotor with a two-lobe, elliptical transverse cross-section, a stator, a carrier and tapered journal bearings, where the rotor is configured to drive the stator.

FIG. 6 is a cross-sectional view of an embodiment of fixed-eccentricity rotary machine assembly 600. Fixed-eccentricity rotary machine assembly 600 can comprise helical rotor 610 having a two-lobe, elliptical transverse cross-section, stator 620 and carrier 630. In some embodiments, such as the one illustrated in FIG. 6, stator 620 is constrained concentrically within carrier 630 and is supported by stator-carrier bearing **640*a* and stator-carrier bearing 640*b* so that it can spin about its axis within carrier 630, but is constrained axially and radially. In this embodiment, stator-carrier bearing 640*a* and 640*b* are tapered journal bearings fitted with annular stator-carrier seal 650*a* and annular stator-carrier seal 650*b*, respectively, to mitigate/reduce or prevent fluid leakage around the rotor-stator assembly. In some embodiments, such as the one illustrated in FIG. 6, rotor 610 is constrained within stator 620 at a position offset from the axis of stator 620 and carrier 630 by a distance equal to the eccentricity. Rotor 610 can be supported by rotor-carrier bearing 660***a* and rotor-carrier bearing 660*b* (which, in FIG. 6 are shown as tapered journal bearings) and anchor pin 670 so that it can spin about its axis within stator 620. In some embodiments, rotor 610 can be coupled to a drive shaft via coupling 680 and driven by a motor, so that it spins about its axis, and drives stator 620 to spin at twice the rate of spin of rotor 610. Thrust bearings, or other suitable bearings can be used instead of tapered journal bearings.

For downhole pump or artificial lift applications, a carrier (such as carrier 630 in FIG. 6) can be fixed rigidly to production tubing (e.g. directly or via larger diameter orbit tubing) which can extend to the surface and accommodate a drive-string as well as carrying the pumped fluid. In at least some embodiments, the carrier can have openings or passages to allow the pumped fluids to pass into the carrier and enter the pump intake.

For downhole pump or artificial lift applications of rotary machines in which the stator is fixed and rotor is configured to spin and orbit within the stator, a drive-string is typically coupled to the rotor and drives the rotor to spin and orbit. For machines where the rotor has a helical profile and an elliptical shape (n=2), the rotor orbits at a radius equal to the eccentricity and it orbits twice as fast as it spins. Thus, with a fixed stator the drive-string also orbits at the same frequency and radius as the rotor. When the eccentricity is fixed and the rotor and stator each spin about their longitudinal axes, a drive-string used to drive the rotor (or stator) to spin would not need to orbit. This simplifies the drive-string design and operation and can reduce failures due to vibration in this region of the overall pump system.

Figure 7:
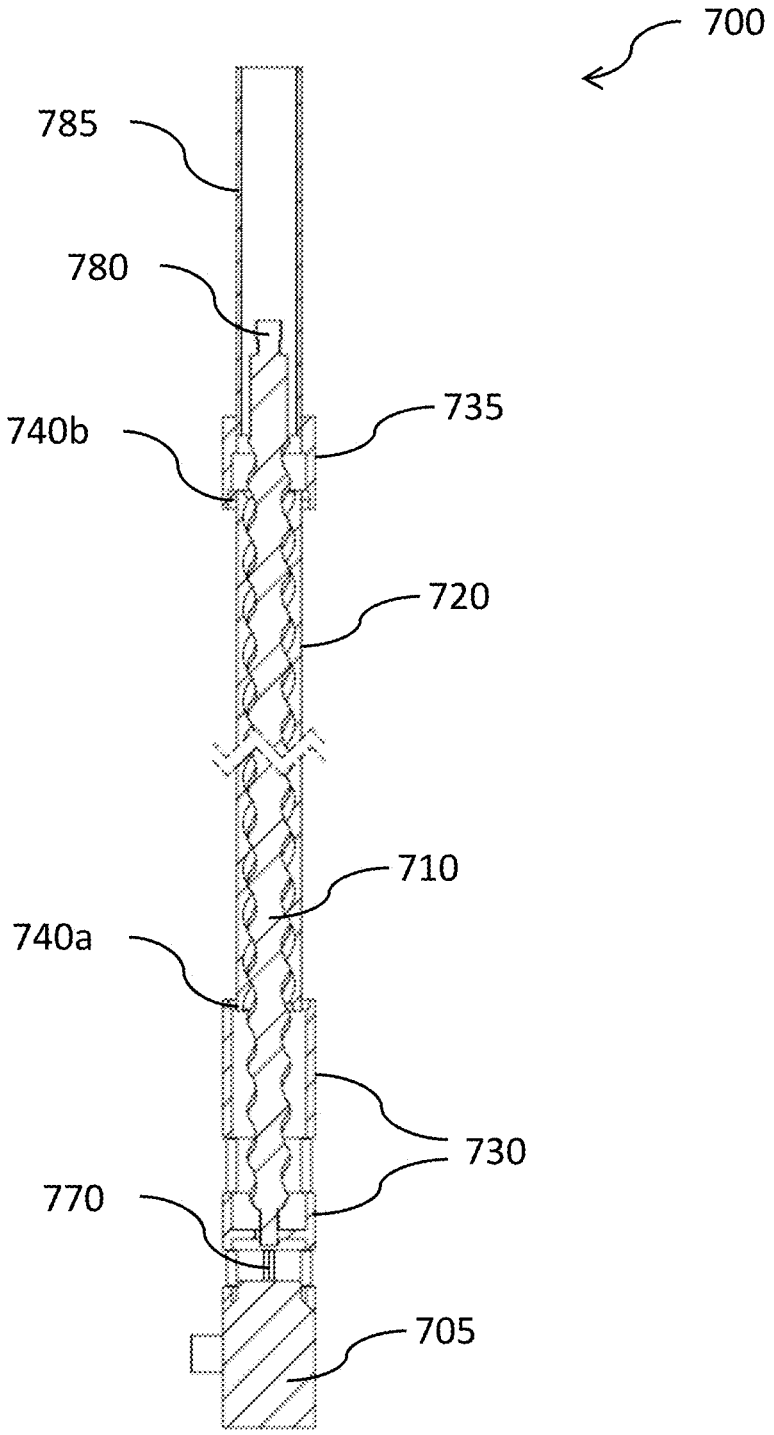
FIG. 7 is a cross-sectional view of an embodiment of a top-driven, fixed-eccentricity downhole pump assembly with a two-lobe helical rotor with elliptical transverse cross-section, a stator, and a carrier, where the rotor is configured to drive the stator.

FIG. 7 shows an embodiment of top-driven downhole pump assembly 700 which can, for example, be inserted into a well. In some embodiments, such as the one illustrated in FIG. 7, torque anchor 705 is at the base of downhole pump assembly 700 and is attached to the well-casing (not shown in FIG. 7), which can be a large diameter pipe that forms the walls of the well. In some embodiments, lower carrier 730 is mounted to torque anchor 705 and supports stator 720 (co-axially) via stator-carrier bearings 740*a* so that it can spin about its axis but is constrained axially and radially. In some embodiments, helical rotor 710 has a two-lobe, elliptical transverse cross-section and extends through stator 720. The axis of rotor 710 can be offset at a fixed distance (eccentricity) from the axis of stator 720. In some embodiments, rotor 710 is supported via anchor pin 770 and bearings (not shown in FIG. 7), so that it can spin about its axis within stator 720. Rotor 710 can be coupled to a drive shaft via coupling 780 and driven by a motor, so that it spins about its axis, and drives stator 720 to spin at twice the rate of spin of rotor 710. In some embodiments, stator 720 is also mounted to and constrained by upper carrier 735 via stator-carrier bearings 740*b*. Upper carrier 735 can be attached to orbit tube 785 (which in turn connects to production tubing) and/or it can be attached to lower carrier 730.

For downhole pump, artificial lift and similar applications, there are a number of ways a system incorporating pumps of the type described herein could be deployed. For example, the pump can be top-driven where the motor is at the surface and is coupled to the rotor (or stator or gear system) via a drive-string (for example, as shown in FIG. 7). In at least some embodiments, top-driven systems are limited to fairly low rotational speeds, not only due to the centrifugal forces from the rotor, but also due to the rotational speeds of the drive-string. In some embodiments, the pump can be used with a direct-drive system, similar to an electric submersible pump (ESP), where the motor is below the surface (e.g. underground). In at least some embodiments, such direct-drive ESP systems are able to achieve higher rotational speeds.

In some embodiments of the rotary machines the rotor and/or the stator are plastic. In some embodiments, the rotor and/or the stator can be metal. In some embodiments, depending on the application, the rotor and/or stator can be made from ceramic, elastomeric other suitable materials or combinations of materials. The material(s) of the rotor can be the same as, or different from, the material(s) of the stator.

Some embodiments of the rotary machines operate with a small clearance between the helical rotor and stator, but without seals between them. In some embodiments it can be desirable to dispose a seal between these components to reduce leakage of fluid between stages. Sealing in helical trochoidal rotary machines is discussed in issued U.S. Pat. No. 10,844,859, which is incorporated by reference herein.

In at least some embodiments, the rotary machines are multi-stage machines. However, the same principles can be applied to machines having a single stage or, in some embodiments, with less than a complete stage (where there is no complete trapped chamber or volume of fluid between the ends of the machine).

Figure 8A:
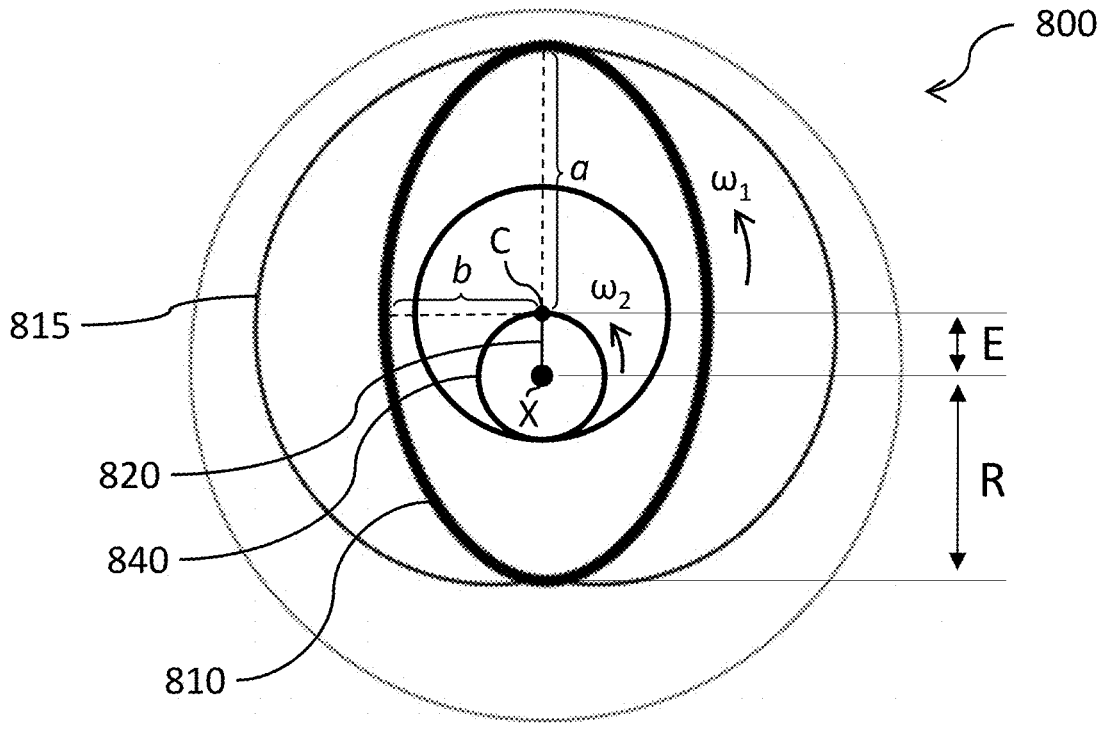
FIG. 8A is a diagram illustrating geometry that can represent an embodiment of a helical rotor-stator assembly in transverse cross-section.

FIG. 8A is a diagram illustrating the geometry of an ellipse rotating about the head of a rotating radial arm. Geometric configuration 800 can represent a helical rotor-stator assembly in transverse cross-section. FIG. 8A can be helpful in understanding the geometry of some embodiments of the rotary machines. In geometric configuration 800, ellipse 810 has center C. Ellipse 810 rotates about center C at angular velocity $\omega_1$ in a counter-clockwise direction relative to a frame of reference in which center C is stationary (just as a helical rotor may spin about its axis).

Ellipse 810 also rotates eccentrically within stator cavity 815, as if it is attached at its centre C to the head of radial arm 820 that rotates about a fixed end X. Circle 840 is the locus of the head of radial arm 820 as it rotates about fixed end X. Ellipse 810 rotates eccentrically at angular velocity $\omega_2$ in a counter-clockwise direction relative to a frame of reference in which fixed end X is stationary. The eccentricity E is the distance between centre C of ellipse 810 and X. Eccentricity E can be defined as the distance between the axis of rotation and the axis of symmetry. Radius R is the length "a" of the semi-major axis of ellipse 810 minus eccentricity E. Radius R is also equivalent to the average or the major and minor radii of the ellipse, i.e (a+b)/2.

In some embodiments of rotary machines, the inverse apex (or ridge or crest) of the corresponding helical stator is always in contact with the outer surface of helical elliptical rotor during a complete revolution of elliptical rotor. This can be achieved by configuring geometry 800 such that the difference between the semi-major axis of the rotor with elliptical cross-section (shown in FIG. 8A as length "a") and the semi-minor axis of the rotor (shown in FIG. 8A as length "b") is twice the eccentricty E. In other words, in some embodiments:

$$a-b=2E$$

In other words, in such embodiments: a=(R+E) and b=(R−E).

Figure 8B:
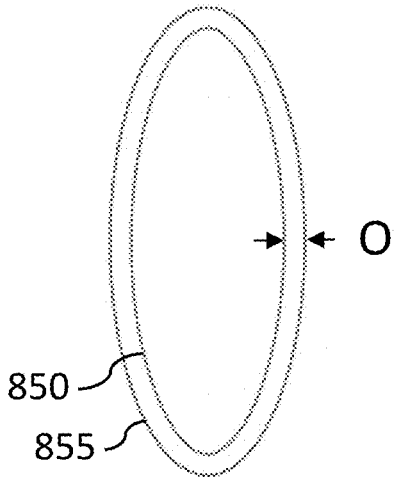
FIG. 8B is a diagram showing an embodiment of a rotor cross-sectional profile inwardly offset from an ellipse.
Figure 8C:
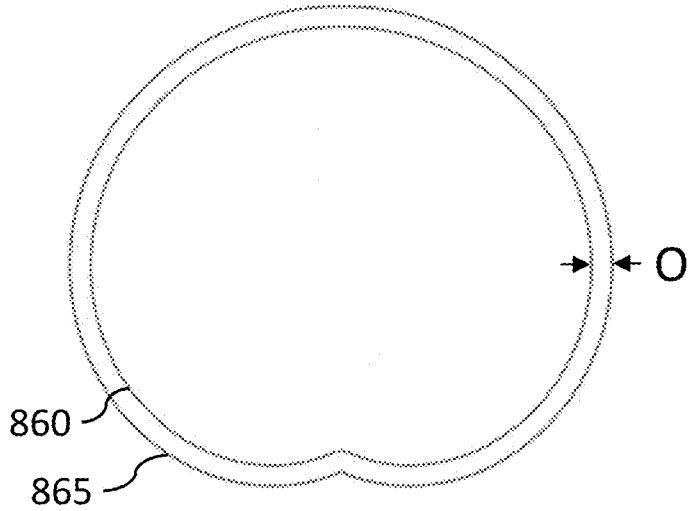
FIG. 8C is a diagram showing an inwardly offset stator cross-sectional profile corresponding to the rotor cross-sectional profile of FIG. 8B.

In variations of some of the helical trochoidal rotary machines described herein, the rotor and stator profiles can be offset along the normals of their planar transverse cross-sections. For example, in some such embodiments where the rotor is hypotrochoidal and undergoes planetary motion relative to a stator that is shaped as an outer envelope of that rotor, the rotor and stator can have cross-sectional profiles that are inwardly offset. For example, FIG. 8B shows rotor cross-sectional profile 850 that is inwardly offset from elliptical shape 855, by offset distance O. FIG. 8C shows cross-sectional profile 860 of a corresponding stator cavity that is offset from outer envelope 865 of an elliptical rotor by offset distance O. In some embodiments where the stator is epitrochoidal, and the rotor undergoes planetary motion relative to the stator and is shaped as the inner envelope of that stator, the rotor and stator can have cross-sectional profiles that are outwardly offset. Such variations in geometry can offer additional advantages, as discussed further in issued U.S. Pat. No. 10,837,444, which is incorporated by reference herein.

In multi-stage embodiments of helical trochoidal rotary machines, if the rotor and stator pitch and all dimensions (including a, b and E, R and O as shown in FIGS. 8A-C) remain constant, or at least essentially constant, along the length of the rotor-stator assembly, then the volume and dimensions of the fluid chambers formed between the helical rotor and the stator is the same along the length of the assembly. Such rotary machines can be used, for example, as pumps and, if driven at constant speed, can provide a substantially steady volumetric flow rate or output.

Figure 9:
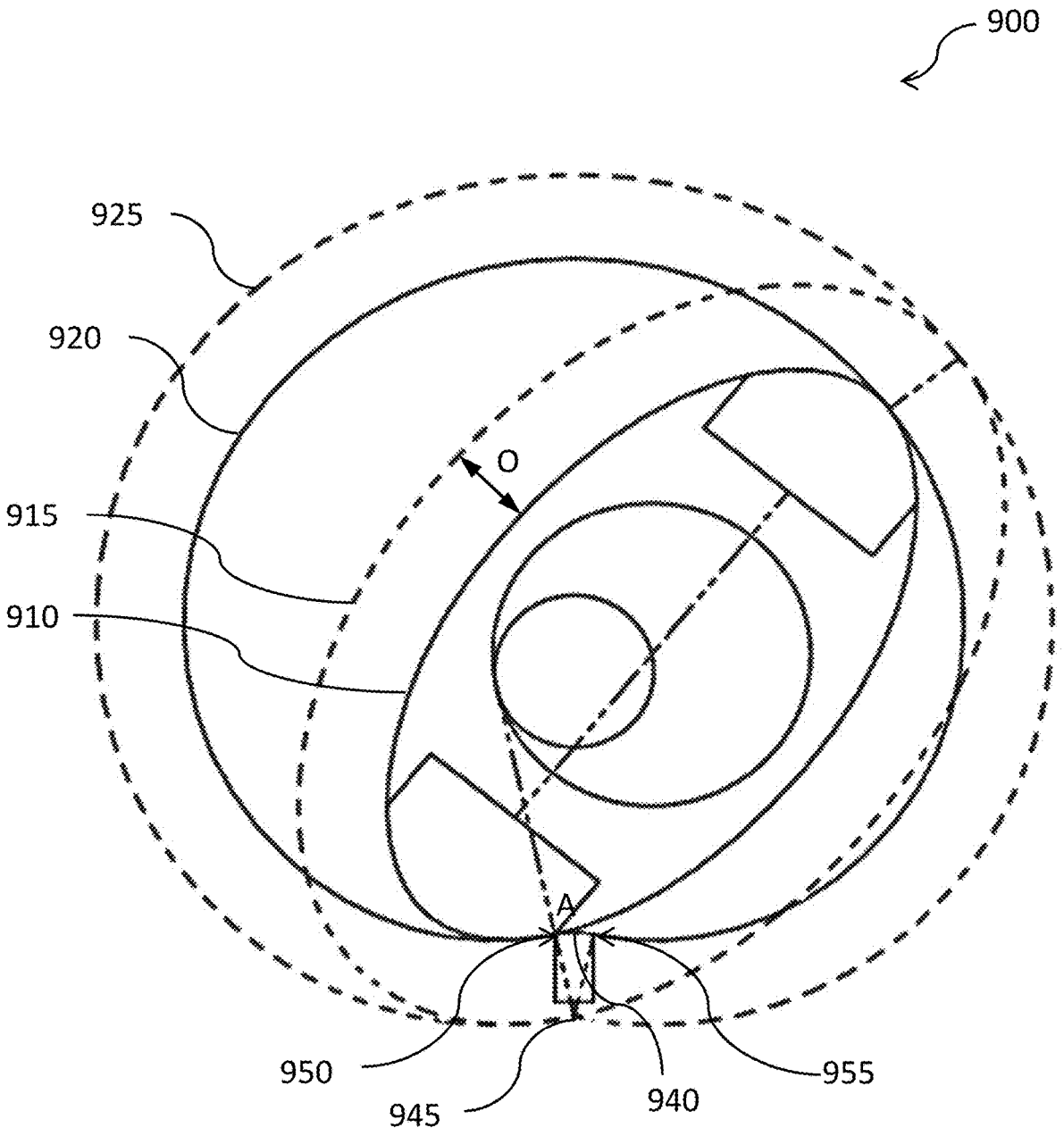
FIG. 9 is a transverse cross-sectional diagram illustrating geometry that can represent an embodiment of a rotor-stator assembly with offset geometry.

FIG. 9 is a transverse cross-sectional diagram of rotor-stator assembly 900, in which a rotor has cross-sectional profile 910 that is inwardly offset from each point on ellipse 915 by a fixed offset distance "O" measured perpendicular to a tangent to ellipse 915 at that point. The resulting rotor profile 910 is not a true ellipse. The corresponding stator cavity profile 920 can be defined as the outer envelope generated when rotor profile 910 undergoes planetary motion, or defined as the correspondingly inward offset of envelope 925 generated by the non-offset hypotrochoid (ellipse 915).

Referring again to FIG. 9, with this "offset" geometry, the inverse apex region 940 of stator is rounded with a circular arc, centered on inverse apex 945 of the "non-offset" geometry. In the plane of the diagram, the contact between inverse apex region 940 of the stator and the rotor tips is continuous but moves back and forth along the circular arc of the inverse apex region between points 950 and 955.

As can be seen, in embodiments such as the one illustrated in FIG. 9, the offset rotor has sharper features than the non-offset rotor, whereas the offset stator has a more rounded inverse apex region than the non-offset stator. For both the offset and non-offset components, the helicization makes the features sharper than they would be in a straight (non-helicized version) of the rotor-stator assembly. Because the lead of the stator is shorter than that of the rotor (by half in the case of a 2:1 rotor-lobe:stator-lobe rotary machine) the "sharpening" of the stator features upon helicization is more dramatic than for the corresponding rotor.

The degree of offset can be selected to give desirable relative rotor and stator profiles. In particular, the degree of offset can be selected to achieve particular design objectives that can be advantageous both physically and also in relation to operation of the rotary machine.

The reaction force that holds the pump components from accelerating in an axial direction is referred to as the axial load. As in various other kinds of pumps, fluid pressure acting on surfaces within a helical trochoidal pump can contribute to the axial load within the pump during operation of the pump.

Figure 10:
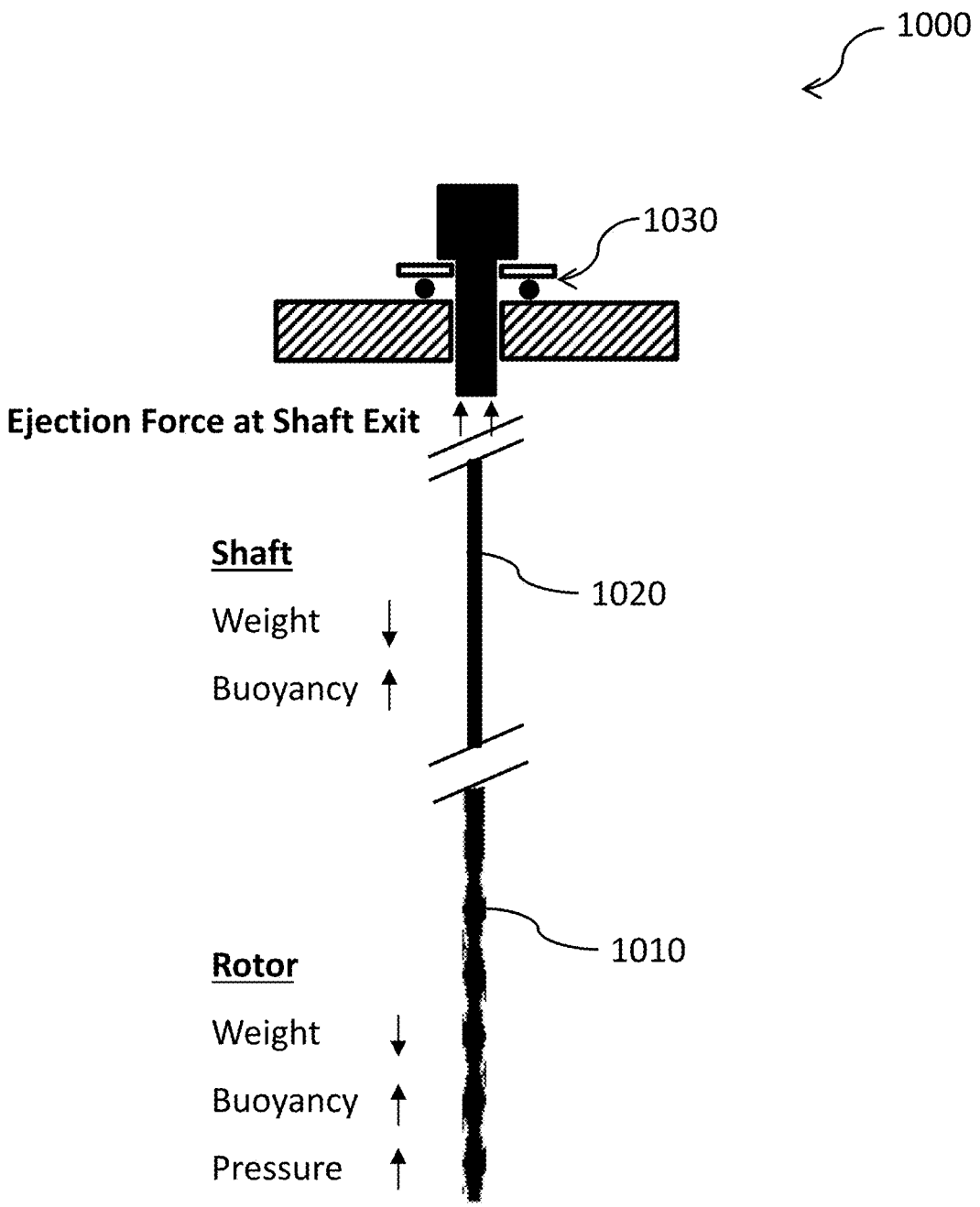
FIG. 10 is a simplified illustration of an embodiment of a pump assembly showing forces acting on various components of the pump.

For illustrative purposes, FIG. 10 shows pump assembly 1000 showing forces acting on the various components. Pump assembly 1000 comprises pump rotor 1010 and shaft 1020 in a vertical orientation. The shaft and rotor weight are supported by thrust bearing 1030 at the top of the assembly. Such an arrangement can be used in a top-driven wellbore installation, for example, where the pump is installed down-hole and is driven via a long drive shaft (also known as a rod-string or drive-string), which is connected to a drive motor (also known as a drive head) located at surface. In such applications, a fluid conduit surrounds the drive shaft, creating an annular volume for transport of fluid from the pump underground to the surface. In at least some embodiments, the drive shaft is designed to be capable of carrying axial load and transmitting torque between the down-hole pump and the surface drive.

Contributions to the overall axial load include:

(i) the weight of the various components (e.g. shaft and rotor)—acting downwards in the illustration;

(ii) pressure forces which include the buoyancy of the various components—acting upwards in the illustration (assuming components are immersed or partially immersed in a liquid), and additional ejection (upward) forces and downward forces due to changes in surface area and a pressure gradient; and (iii) friction.

During operation of the pump assembly, the pressure differential across the pump affects the net pressure forces on the components, and the pump characteristics and flow rate affect the friction force. The fluid pressure (from the fluid being pumped) acting on the surfaces within the pump is different when the pump is operating versus when it is not.

In a typical top-driven installation using a progressive cavity pump (PCP), shaft weight and rotor pressure force (fluid pressure on the rotor) are the dominant forces in the system. With a PCP, both of these forces induce tensile load on the shaft, resulting in a downward force on the top thrust bearing.

In top-driven installations using a helical trochoidal pump, the shaft weight applies a tensile load to the shaft. The rotor pressure force can add to or counteract this tensile load, depending on the geometry of the pump. The geometry of a helical trochoidal pump can be selected or modified to adjust the axial load, for example, to achieve a desired axial load. For example, the net force from fluid pressure acting on the rotor (rotor pressure force) can be modified such that this force either:

a) induces a tensile load (acting downwards in the illustration), adding to the top bearing load when pressure is applied, i.e. when there is more differential pressure across the pump;

b) induces a compressive load (acting upwards in the illustration), reducing the top bearing load when pressure is applied; or c) induces negligible (or a neutral) load, resulting in substantially no change on the top bearing load when pressure is applied.

A helical trochoidal pump can be designed so that, as the pump generates pressure, the net force on the rotor due to that fluid pressure is toward the high-pressure side of the pump.

This ability to control and/or adjust axial load through selection of particular design parameters for helical trochoidal pumps provides an opportunity to improve the performance, cost, and/or durability of the pumps. For example, pumps can be designed so that axial loads on the drive shaft and thrust bearing(s) can be reduced, improving the longevity and/or reducing the cost of these components.

It has been observed that, during operation of embodiments of a helical trochoidal pump, if the rotor is allowed to move slightly in the axial direction (without allowing the drive shaft to rotate), reverse flow occurs. In other words, if the rotor moves away from the high-pressure outlet of the pump, an additional volume of fluid is pumped toward the high-pressure outlet. If the volume of fluid pumped toward the high-pressure outlet is the same as the volume created by movement or the rotor away from the high-pressure side, then the rotor is neutrally balanced. More generally, the overall high-pressure outlet fluid volumes are unchanged by an axial motion of the pump. This effect can be engineered to be neutral, positive, or negative.

In contrast, for a PCP an axial movement of the rotor away from the high-pressure side of the pump (without rotation of the rotor), causes fluid to move away from the high-pressure side (opposite to what happens with a helical trochoidal pump).

Figure 11A:
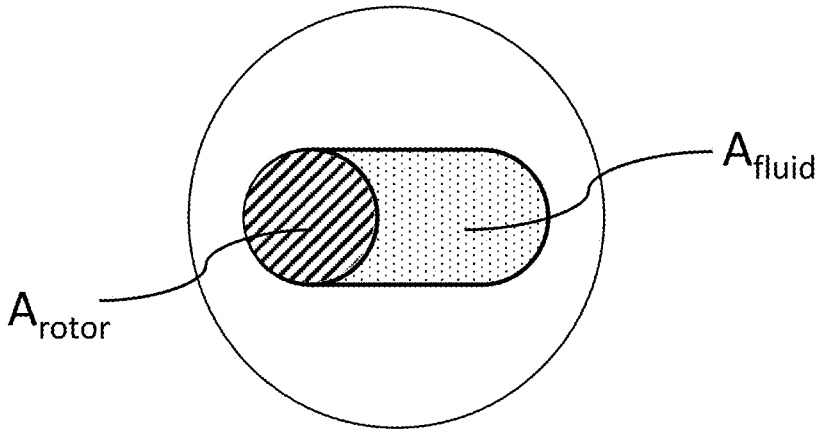
FIG. 11A is a cross-sectional view of a rotor-stator assembly of a progressive cavity pump (PCP) showing the rotor cross-sectional area ($A_{rotor}$) and the fluid cross-sectional area ($A_{fluid}$).
Figure 11B:
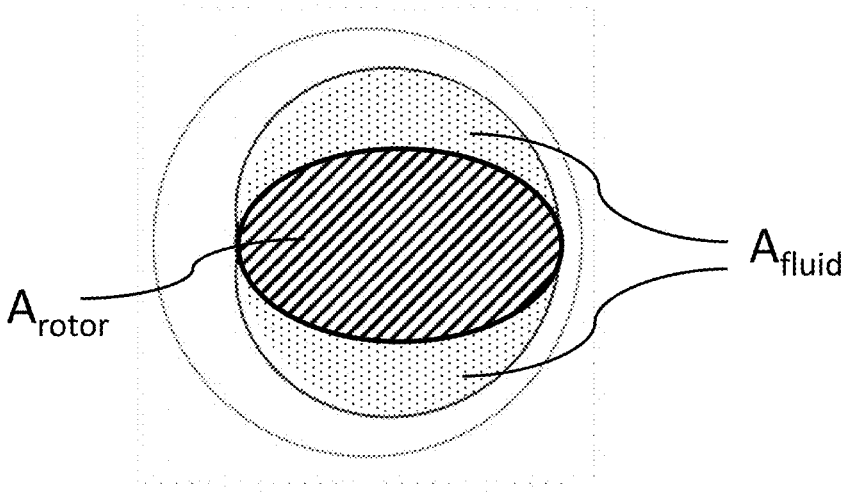
FIG. 11B is a cross-sectional view of a rotor-stator assembly of a helical trochoidal pump showing the rotor cross-sectional area ($A_{rotor}$) and the fluid cross-sectional area ($A_{fluid}$).

The relationship between rotor pressure force ($F_R$) and pressure differential and pump geometry is unusual in helical trochoidal pumps, when compared to other pumps, and in particular when compared to a PCP. For both these pumps, the rotor pressure force ($F_R$) can be defined as a function of the rotor cross-sectional area ($A_{rotor}$), fluid cross-sectional area ($A_{fluid}$), and differential pressure ($\Delta P$) across the pump. The rotor cross-sectional area ($A_{rotor}$) and fluid cross-sectional area ($A_{fluid}$) for a PCP are shown in FIG. 11A, and for a helical trochoidal pump are shown in FIG. 11B. In each case $A_{fluid}$ is the total area shaded with a dot-pattern. The rotor pressure force for a helical trochoidal pump can be represented by equation (1):

$$F_R=\Delta P(A_{rotor}-A_{fluid}) \tag{1}$$

The rotor pressure force for a PCP can be represented by equation (2):

$$F_R=\Delta P(A_{rotor}+2A_{fluid}) \tag{2}$$

From examination of these relationships and knowing that the rotor and fluid cross-sectional areas are both real positive values, it can be seen that the PCP rotor pressure force is always positive but, depending on the relative areas of the rotor and fluid cross-sections in a helical trochoidal pump, the rotor pressure force can be positive, negative, or equal to zero (neutral).

The "difference-in-areas" ($A_{rotor}-A_{fluid}$) is a function of the pump cross-sectional geometry, and for a helical trochoidal pump can be characterized by three geometric factors: radius (R), eccentricity (E), and offset (O). In general terms, the radius and offset dictate the size of the pump, and the eccentricity dictates the cross-sectional shape (e.g. amount of elongation) of the elliptical (or offset elliptical) rotor. The effect on the difference-in-areas of modifying these geometric factors is analyzed further below.

First, looking at how the difference-in-areas ($A_{rotor}-A_{fluid}$) is affected by varying the pump eccentricity (E): the difference-in-areas can be calculated as a function of radius-minus-offset squared $(R-O)^2$ such that a general relationship of the difference-in-areas can be defined in a non-dimensionalized sense (i.e. to have a relationship that holds true for any size of pump). This is achieved by dividing the eccentricity (E) by the radius-minus-offset (R−O) as in equation (3) below, and the difference-in-areas by the square of the radius-minus-offset $(R-O)^2$ as in equation 4 below.

$$\text{Eccentricity ratio} = \frac{E}{R-O} \tag{3}$$

$$\text{Non-dimensional area} = \frac{(A_{rotor}-A_{fluid})}{(R-O)^2} \tag{4}$$

Figure 12:
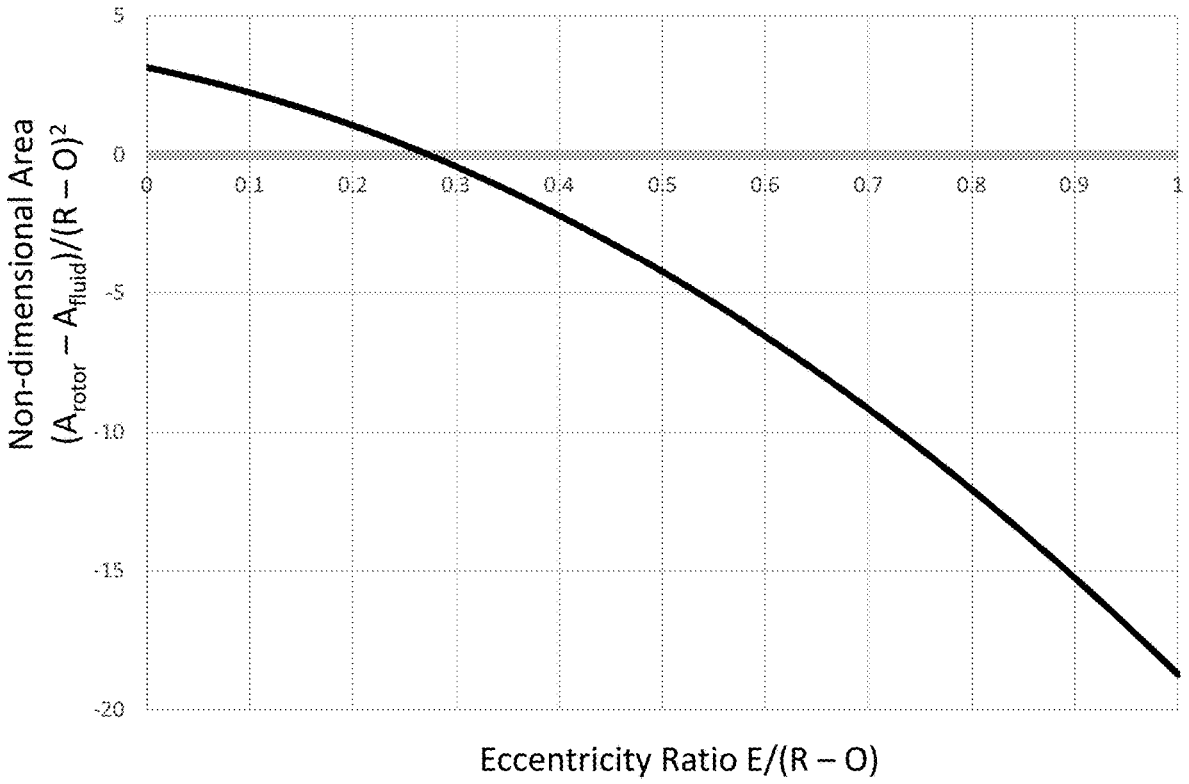
FIG. 12 is a plot illustrates the non-dimensionalized difference-in-areas ($A_{rotor}-A_{fluid}$) as a function of eccentricity (E) for a helical trochoidal rotary machine.

Radius-minus-offset (R−O) is the overall scaling function, such that as (R−O) increases so does the overall size of the pump. FIG. 12 illustrates the non-dimensionalized difference-in-areas ($A_{rotor}-A_{fluid}$) as a function of eccentricity.

A neutral rotor pressure force is achieved when the difference-in-areas is zero or, in other words, the fluid cross-sectional area ($A_{fluid}$) is equal to the rotor cross-sectional area ($A_{rotor}$). This occurs when the eccentricity ratio (see equation (3)) is approximately equal to 0.27. When the eccentricity ratio is below this threshold, the net pressure force on the rotor ($F_R$) is in the positive direction (i.e. away from the high pressure side). Conversely, when the eccentricity ratio of the pump is above this threshold, the net pressure force on the rotor ($F_R$) is in the negative direction.

Figure 13A:
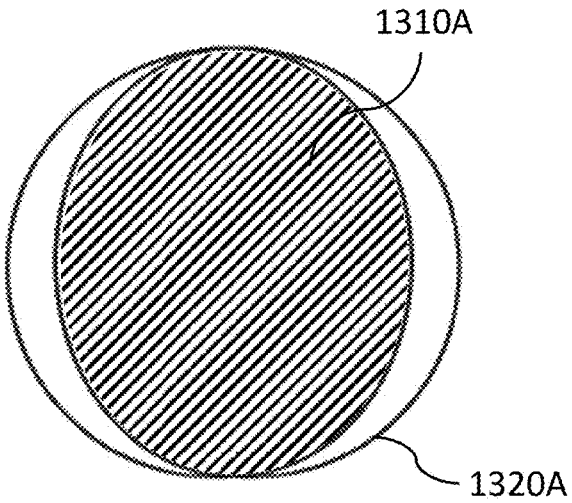
FIG. 13A is a simplified cross-sectional diagram showing the rotor and stator for a helical trochoidal rotary machine with an eccentricity ratio of 0.1.
Figure 13B:
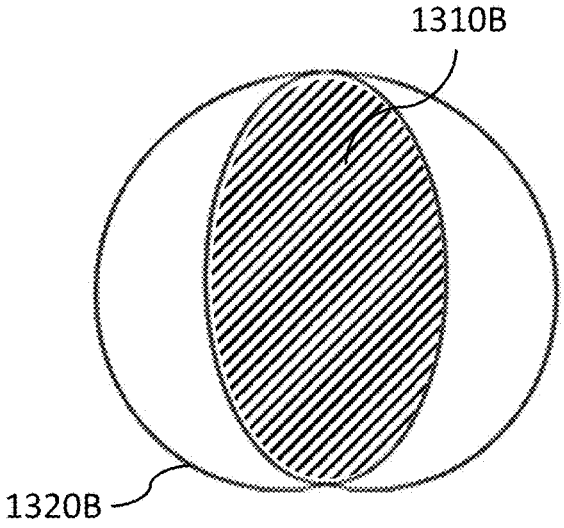
FIG. 13B is a simplified cross-sectional diagram showing the rotor and stator for a helical trochoidal rotary machine with an eccentricity ratio of 0.27.
Figure 13C:
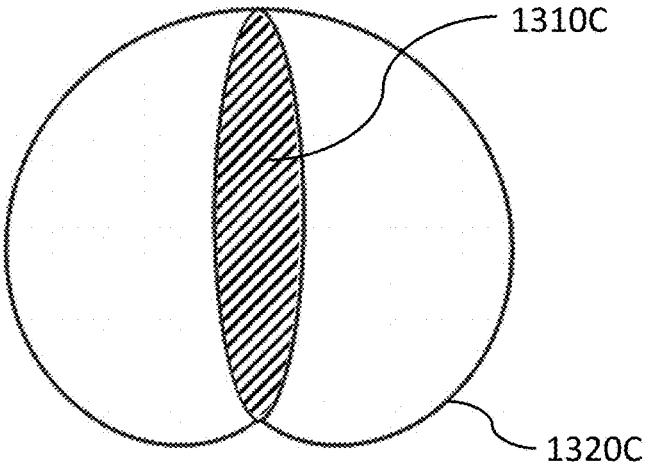
FIG. 13C is a simplified cross-sectional diagram showing the rotor and stator for a helical trochoidal rotary machine with an eccentricity ratio of 0.65.

A large positive difference-in-areas, and thus positive rotor pressure force, is achieved by pumps with low eccentricity. Conversely, a large negative difference of areas, and thus negative rotor pressure force, is achieved by pumps with high eccentricity. In some embodiments of helical trochoidal pumps in which a hypotrochoidal (2-lobe) rotor has an elliptical or offset-elliptical cross-sectional shape, a preferred range of pump eccentricity ratio (as defined in Equation (3) above) is approximately between 0.1 to 0.65, with the lower end of the range producing a rotor with a cross-sectional shape that is more rounded, and the higher end of the range producing a rotor with a cross-sectional shape that is more elongated. A lower limit of this preferred eccentricity ratio range can be bounded practically by the low eccentricity creating a pump with low fluid area ($A_{fluid}$) and therefore resulting in a pump having an unacceptably low pumping capacity. A higher limit of this preferred eccentricity ratio range provides a pump that has high pumping capacity, but results in a rotor with a thin, elongated cross-section that can be fragile and/or may be at or close to the physical limit of the manufacturability and/or structural effectiveness due to material strength and lack of stiffness of the geometry. FIG. 13A is a cross-sectional view of an embodiment of a helical trochoidal pump with an eccentricity ratio of 0.1, showing rotor 1310A in stator cavity 1320A. FIG. 13B is a cross-sectional view of an embodiment of a helical trochoidal pump with an eccentricity ratio of 0.27, showing rotor 1310B in stator cavity 1320B. FIG. 13C is a cross-sectional view of an embodiment of a helical trochoidal pump with an eccentricity ratio of 0.65, showing rotor 1310C in stator cavity 1320C. FIGS. 13A-C illustrate how the cross-sectional profile of the rotor changes with eccentricity ratio, and how the difference-in-areas varies from positive to zero to negative for eccentricity ratios of 0.1, 0.27 and 0.65, respectively.

When an eccentricity ratio of 0.1 is used and the offset (O) is zero, a maximum non-dimensional difference of areas of 2.2 is achieved (see FIG. 12). In practice, this means that a pump with a radius of 1 inch (R=1 inch) has a rotor major diameter (e.g. double dimension a in FIG. 8A) of 2.2 inches, a rotor minor diameter (e.g. double dimension b in FIG. 8A) of 1.8 inches, and a difference of areas of 2.2 $in^2$. This translates to a rotor pressure force ($F_R$) of 2.2 lbs per 1 psi of differential pressure across the pump, away from the high-pressure side of the pump (in the positive direction) and thus adding to the axial load in the system.

When an eccentricity to radius ratio of 0.65 is used and the offset is zero, a minimum non-dimensional difference of areas of −7.8 is achieved (see FIG. 12). In practice, this means that a pump with a radius of 1 inch (R=1 inch) has a rotor major diameter of 3.3 inches, a minor diameter of 0.7 inches, and a difference-in-areas of −7.8 $in^2$. This translates to a rotor pressure force of 7.8 lbs per 1 psi of differential pressure across the pump, towards the high-pressure side of the pump (in the negative direction) and thus counteracting the axial load in the system.

In some embodiments, and referring back to FIG. 10, if a pump is to be driven by shaft through a seal assembly from the high-pressure side of the pump, and a reduced or minimal axial load is desirable on the driven shaft, a pump eccentricity that minimizes, or at least reduces, the net load on the driven shaft can be chosen. The driven shaft creates a load that is a function of the shaft area at the seal interface, differential pressure at the seal interface, pump inlet pressure relative to the low-pressure side of the seal interface, fluid drag forces, shaft and rotor weight and buoyancy forces. Pump geometry can be selected to at least partially counteract these forces, taking into account the physical constraints and trade-offs discussed herein.

Figure 14:
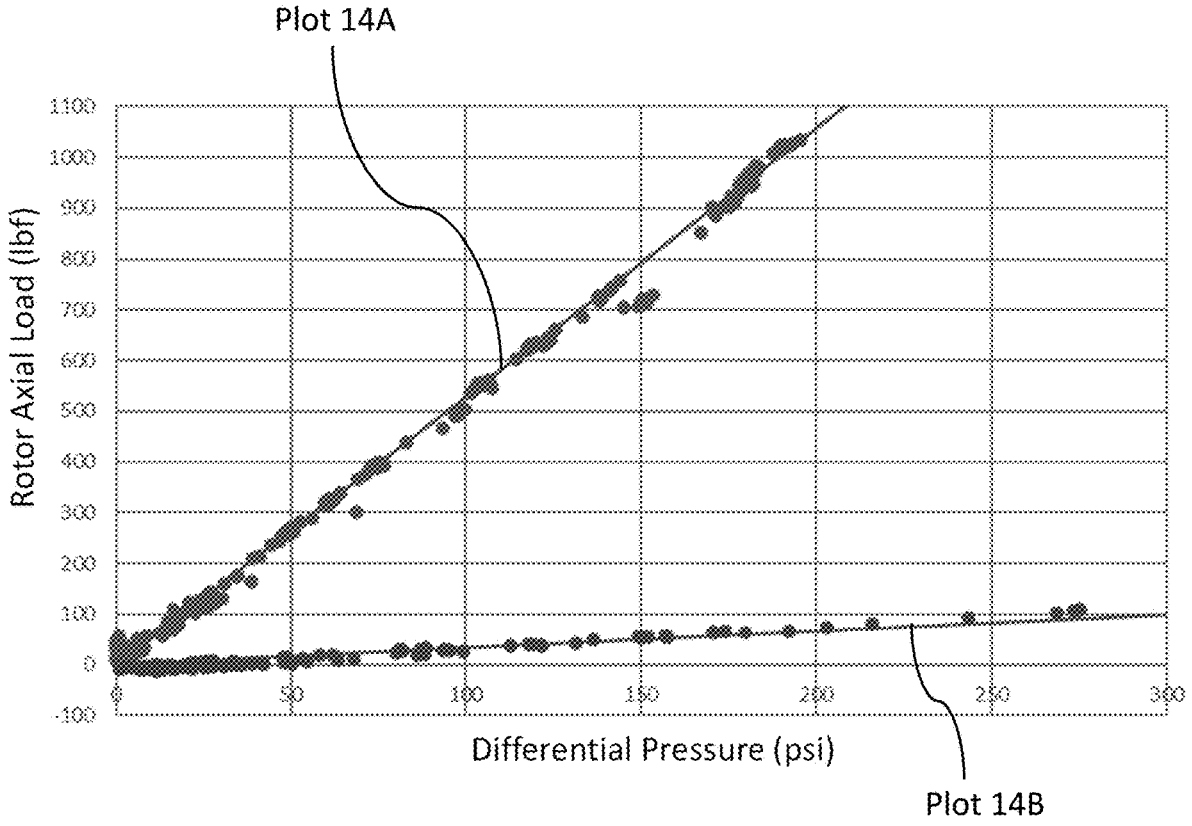
FIG. 14 is a graph showing theoretical and experimental axial loads as a function of differential pressure for a PCP pump and for a helical trochoidal pump with a similar fluid cross-sectional area.

A comparison of theoretical and experimental axial loads as a function of differential pressure for a PCP pump and a helical trochoidal pump (with a hypotrochoidal rotor having an approximately elliptical cross-sectional shape) with similar fluid cross-sectional areas ($A_{fluid}$) are illustrated in FIG. 14. Plot 14A shows the theoretical rotor axial load for the PCP pump as a solid line with the experimentally determined axial loads shown as data points scattered abut the solid line. Plot 14B shows the theoretical rotor axial load for the helical trochoidal pump as a solid line with the experimentally determined axial loads shown as data points scattered about the solid line. In this particular example the pumps and drive shafts are horizontally-oriented, with the drive shaft on the high-pressure side of the pump. As such, the axial load is neutral without fluid pressure applied in the system. Further, in both the PCP and helical trochoidal pump, a 1" diameter shaft creates a negative ejection force of 78.5 lbs/100 psi of pressure. The other shaft forces are negligible.

The helical trochoidal pump has a positive rotor axial load of 33 lbs/100 psi, which is a result of a negative shaft ejection force of 78.5 lbs/100 psi counteracted by a positive rotor pressure force of 111.5 lbs/100 psi. The PCP pump has a positive rotor axial load of 528 lbs/100 psi, which is a result of a negative shaft ejection force of 78.5 lbs/100 psi counteracted by a positive rotor pressure force of 606.5 lbs/100 psi.

Figure 15:
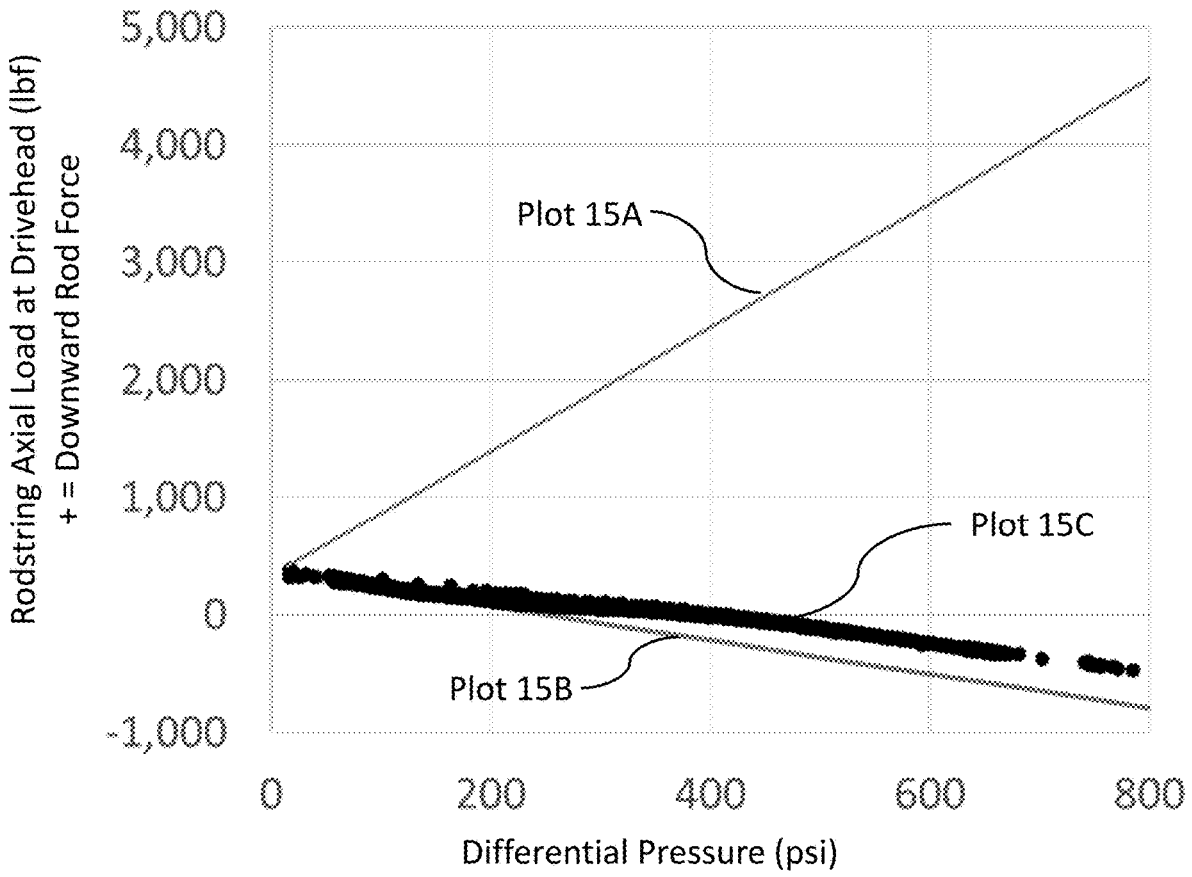
FIG. 15 is a graph showing theoretical axial load as a function of differential pressure for a PCP pump, and showing theoretical and experimental axial loads as a function of differential pressure for a helical trochoidal pump with a similar fluid cross-sectional area.

Another example showing theoretical axial load as a function of differential pressure for a PCP pump, and showing theoretical and experimental axial loads as a function of differential pressure for a helical trochoidal pump (with a hypotrochoidal rotor having an approximately elliptical cross-sectional shape) with similar fluid cross-sectional areas ($A_{fluid}$) is shown in FIG. 15. Plot 15A shows the theoretical axial load for the PCP pump as a solid line. Plot 15B shows the theoretical axial load for the helical trochoidal pump as a solid line, and Plot 15C shows data points for experimentally-determined axial loads for the helical trochoidal pump. In this example, the pumps and drive shafts are oriented vertically, with the pump in a well approximately 100 ft below ground, and the drive shaft located on the high-pressure side of the pump. The 100 ft of drive shaft is a 400 lb load hanging from a bearing assembly at surface, as is seen in FIG. 15 for the axial load with no pressure applied to the pump. Fluid drag and buoyancy forces are present in the data, however these are relatively small (~50 lbs), and do not change substantially with applied pressure. The sensor was located at the top of the well, so FIG. 15 shows the axial load of the rotor plus the drive shaft and surface seal.

A 1¼" diameter shaft creates a negative ejection force at surface of 123 lbs/100 psi of pressure for both pumps. It can be seen from FIG. 15 that the helical trochoidal pump produces a near-neutral load at the surface, whereas the PCP in contrast applies a larger positive load at the surface (i.e. more weight on the bearing).

If the rotary machine is oriented at an angle (neither horizontally or vertically), the axial component of the weight and buoyancy can be taken into account.

In comparing these load characteristics, it can be seen that embodiments of helical trochoidal pumps with particular geometries can provide significant advantages in reducing axial loads. This, in turn can reduce the engineering and maintenance requirements associated with the bearings used to support the rotating shaft transmitting these loads. Specifically, in some embodiments of pump assemblies using helical trochoidal pumps, bearings with significantly reduced (approximately 5-10× lower) load ratings can be used. Bearing friction forces will tend to be reduced, which can increase the longevity of bearing components, and/or improve the efficiency of the bearing system within the pump assembly.

For example, for top-driven pump assemblies, where a pump is driven by a drive shaft passing through a seal assembly from the high pressure side of the pump, in some applications the drive shaft can be short and in a horizontal orientation. In at least some of these cases, it can be desirable for the drive shaft to be in slight tension at all times so that the bearing arrangement is required to hold a small or minimal thrust load in only one direction. Pump geometry can be selected so that the difference-in-areas is sufficiently positive so that the tension created from the rotor pressure force is slightly more than the drive shaft ejection force, for example, an eccentricity ratio of about 0.21 for a 1" diameter drive shaft may be suitable. In other top-driven pump applications the drive shaft could be thousands of meters long and vertically oriented. In this case a pump geometry having an eccentricity ratio greater than 0.27 can be selected so the rotor pressure force at least partially counteracts the weight of the drive shaft, in order to reduce the bearing load. If buckling is a concern, it may be desirable to have the rotor pressure force be zero so that no part of the drive shaft is in compression, but the pump is not increasing the bearing load. In this case, an eccentricity ratio that is less than 0.27 can be suitable, depending on the size of the drive shaft.

For "direct drive" pump assemblies where a pump is driven by a shaft on the low-pressure side of the pump, again it can be desirable to have the drive shaft in slight tension at all times. In this case, the drive shaft is on the low-pressure side so an eccentricity ratio slightly above 0.27 can be suitable so that the fluid pressure on the rotor adds slight tension to the drive shaft.

For pump assemblies (or other rotary machines) where the rotor and stator are each constrained axially in both directions by bearings (such as an assembly where the rotor is configured to drive the stator, for example, as shown in FIG. 6), in at least some embodiments, the pump can be made simpler and manufactured more easily if the geometry is selected so that the reaction force required to prevent the rotor or stator from moving axially is in the same direction at any differential pressure. This allows two of the combination thrust and radial bearings to be replaced with bearings that just need to hold a radial load. Springs or the weight of the components can provide the preload for the remaining thrust bearings. The preferred eccentricity ratio depends on the orientation of the pump, whether the driveshaft is on the high pressure side or low pressure side, and whether the rotor or stator is being driven.

In some pump assemblies (or other rotary machines), the motor could drive the stator and other axial load characteristics can be desirable. Again, the geometry can be selected to provide the desired axial load characteristics.

In some embodiments and applications of rotary machines, the pressure force on the rotor can be tuned so that an axial shift in position of the rotor or stator occurs when a certain differential pressure is reached. This can be used to trigger a change in a mechanical configuration of the machine, for example, to prevent (or at least reduce) damage, to engage a different set of gears, or to use a different section of the machine, etc. For example, in some system embodiments the rotor of the rotary machine is coupled to a gear box and the axial load acts against a spring such that when a particular axial load is reached, due to an increase or decrease in pressure, the gear ratio changes.

Figure 16:
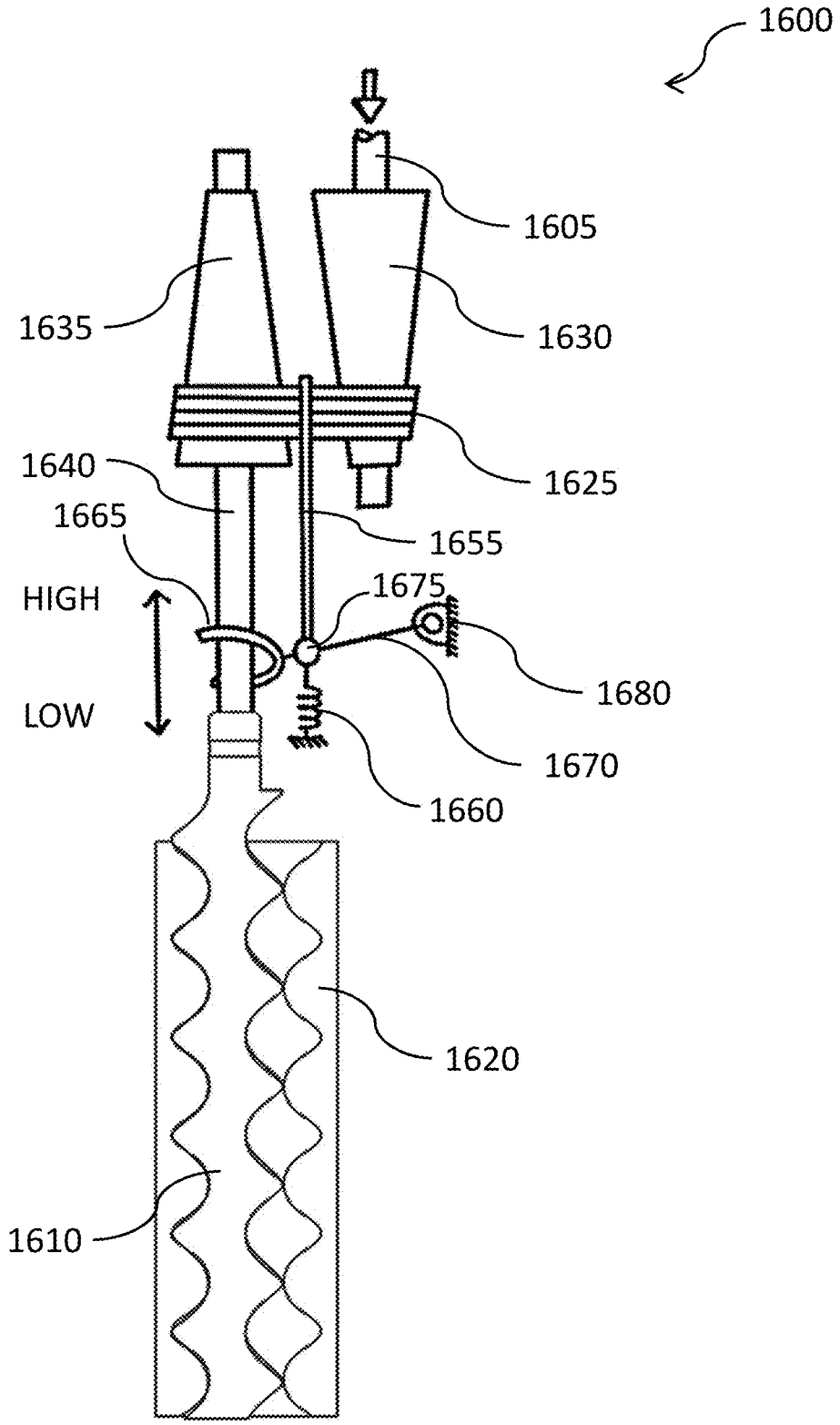
FIG. 16 is front cross-sectional view of a system comprising a helical trochoidal rotary machine and a continuously variable transmission used to drive the machine, the system configured so that a change in axial load causes a change in gear ratio.

FIG. 16 is a simplified illustration of an embodiment of system 1600, showing helical rotor 1610 within stator 1620. Drive shaft 1605 is driven by a motor (not shown), and drives rotor 1610 to spin within stator 1620 via a continuously variable transmission (CVT). The CVT comprises a pair of transmission cones 1630 and 1635 coupled to one another via drive belt 1625, so that rotation of drive shaft 1605 causes rotation of rotor drive shaft 1640 which, in turn, drives rotor 1610 to spin. The gear ratio changes as the position of drive belt 1625 on transmission cones 1630 and 1635 changes, the gear ratio being higher as the drive belt moves upwards in the illustration, and the gear ratio being lower as the drive belt moves downwards in the illustration (as indicated on the double-headed arrow). System 1600 is configured so that a change in axial load, due to an increase or decrease in pressure, causes the gear ratio to change. Drive belt 1625 is coupled to a connecting rod 1655 and spring 1660. Connecting rod 1655 is coupled to rotor drive shaft 1640 via collar 1665 (within which rotor drive shaft 1640 can rotate), pivoting arm 1670 and connector 1675. Pivoting arm 1670 pivots about fulcrum 1680. As the axial load varies, axial force on sprung connecting rod 1655 changes, which causes the gear ratio to change. For example, when the axial load increases the system shifts to a lower gear.

Thus, in some embodiments the system can be configured to passively or seamlessly select gears or activate and/or adjust a CVT based on pressure.

In some embodiments, the axial load can act against a spring such that when a particular axial load is reached the rotor moves from a tight fit rotor section to a looser fit rotor section to provide increased slip, and thus passively control pressure output. In some embodiments, a change in axial load could cause the rotor to move into a tighter fit, thereby allowing the engineered axial load to lightly drive a tapered rotor-stator into a desired tolerance as it wears (see, for example, FIG. 17 below). Much of the description herein has focussed on embodiments of helical trochoidal rotary machines with a trochoidal rotor (and particularly on pumps with an elliptical or approximately elliptical rotor) and corresponding outer envelope stator cavity. In other embodiments, helical trochoidal rotary machines can have an epitrochoidal stator cavity profile and corresponding rotor (inner envelope) profile that are each swept along helical paths. These embodiments have the same relative motion of the rotor and stator (with the same orbit and spin) as machines with a trochoidal rotor and corresponding outer envelope stator cavity. The present approach can be applied to generate embodiments of helical rotary machines based on a hypotrochoidal or epitrochoidal rotor, where the components have more than two or three lobes.

In some embodiments, the rotor (and/or optionally the stator) can be rotated using any suitable drive mechanism.

Much of the description herein has focused on embodiments of helical trochoidal rotary machines in which the rotor and stator pitch and all dimensions (including a, b and E, R and O as shown in FIGS. 8A-C) remain constant along the length of the rotor-stator assembly, where the volume and dimensions of the fluid chambers formed between the helical rotor and the stator are the same along the length of the assembly.

In other multi-stage embodiments, the rotor-stator geometry can be varied, in a continuous or stepwise manner, along the axis of the rotary machine. In some embodiments the rotor and stator are tapered. In some embodiments, such variations can cause the volume of the fluid chambers to vary along the axis of the machine, such as may be desirable for compressor or expander applications, for example. In other embodiments, it can be advantageous to vary the geometry of the rotor-stator along the axis of the rotary machine, while keeping the volume of the fluid chambers formed between the helical rotor and the stator approximately the same along a length of the rotor-stator assembly. The ability to control axial load can also be important in machines in which the rotor-stator geometry varies along the axis of the rotary machine, and a similar approach to that described above can be applied to adjust or control the axial load in such machines. For example, the machine geometry can be selected to achieve a desired axial load. In some embodiments in which the geometry of the rotor-stator varies along the axis of the rotary machine (for example, helical trochoidal rotary machines that are used as compressors or expanders), the machine geometry can be selected to achieve a neutral axial load. This can reduce friction in such machines.

Figure 17:
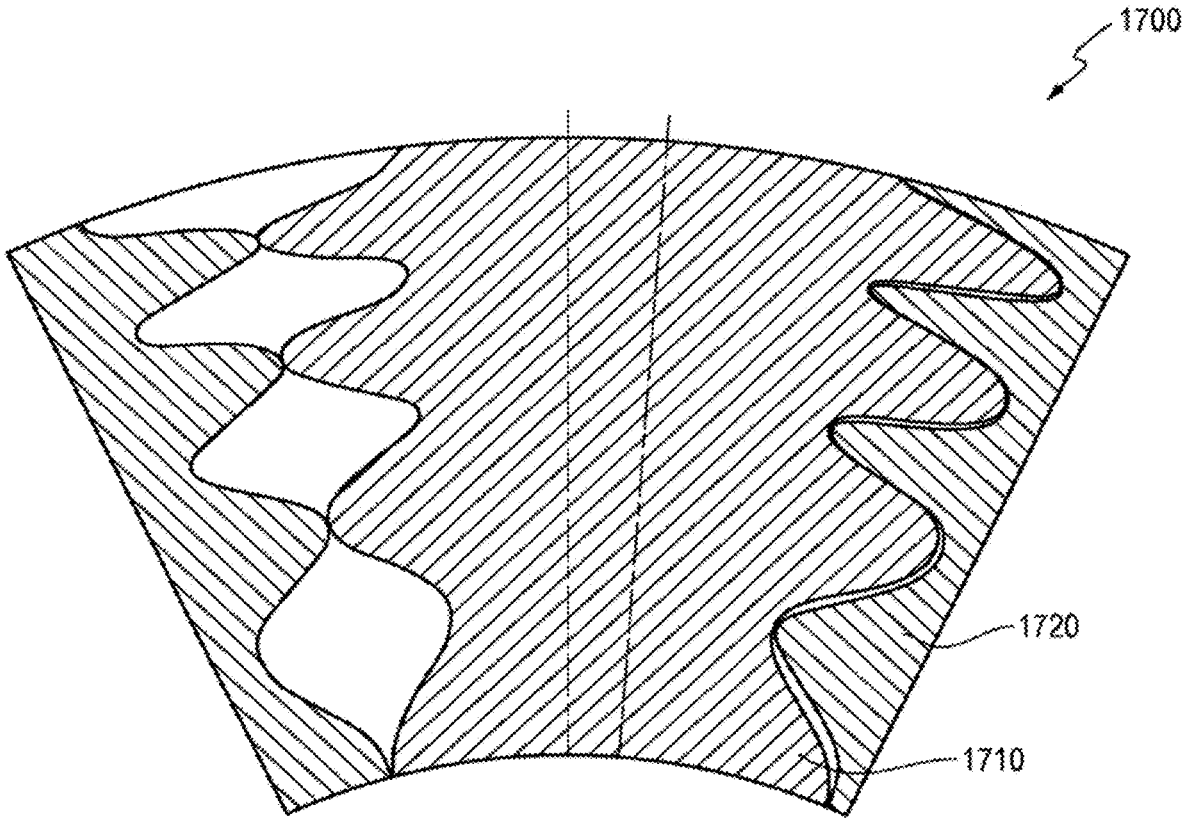
FIG. 17 is a simplified cross-sectional drawing of a portion of a rotor-stator assembly from a rotary machine, in which the geometry of the rotor-stator varies along the axis of the assembly.

FIG. 17 is a simplified illustration of a portion of rotor-stator assembly 1700 from a rotary machine in cross-section, to illustrate an embodiment in which the geometry of the rotor-stator varies along the axis of the rotary machine. In this embodiment, multiple parameters (e.g. diameter, pitch etc.) are varied in combination so that the volume of the fluid chambers formed between helical rotor 1710 and corresponding stator 1720 remains approximately the same along a length of rotor-stator assembly 1700. In the illustrated embodiment, the rotor and stator axes are non-parallel.

Throughout the following description, specific details are set forth in order to provide a more thorough understanding of the invention. However, the invention can be practiced without these particulars. In other instances, well-known elements have not been shown or described in detail to avoid unnecessarily obscuring the description. Accordingly, the specification and drawings are to be regarded in an illustrative, rather than a restrictive sense.

Unless the context clearly requires otherwise, throughout the description and the claims:

- "comprise", "comprising", and the like are to be construed in an inclusive sense, as opposed to an exclusive or exhaustive sense; that is to say, in the sense of "including, but not limited to";
- "connected", "coupled", or any variant thereof, means any connection or coupling, either direct or indirect, permanent or non-permanent, between two or more elements; the coupling or connection between the elements can be physical, logical, or a combination thereof;

"herein", "above", "below", and words of similar import, when used to describe this specification, shall refer to this specification as a whole, and not to any particular portions of this specification;

"or", in reference to a list of two or more items, covers all of the following interpretations of the word: any of the items in the list, all of the items in the list, and any combination of the items in the list;

the singular forms "a", "an", and "the" also include the meaning of any appropriate plural forms;

Unless otherwise indicated, words that indicate directions such as "vertical", "transverse", "horizontal", "upward", "downward", "forward", "backward", "inward", "outward", "vertical", "transverse", "left", "right", "front", "back", "top", "bottom", "below", "above", "under", and the like, used in this description, depend on the specific orientation of the apparatus described and illustrated. The subject matter described herein can assume various orientations. Accordingly, these directional terms are not strictly defined and should not be interpreted narrowly.

Where a component is referred to above, unless otherwise indicated, reference to that component (including a reference to a "means") should be interpreted as including as equivalents of that component any component which performs the function of the described component (i.e., that is functionally equivalent), including components which are not structurally equivalent to the disclosed structure which perform the function of the described component.

Specific examples of systems, methods and apparatus have been described herein for purposes of illustration. These are only examples. The technology provided herein can be applied to systems other than the example systems described above. Many alterations, modifications, additions, omissions, and permutations are possible within the practice of this invention. This invention includes variations on described embodiments that would be apparent to the skilled addressee, including variations obtained by: replacing features, elements and/or acts with equivalent features, elements and/or acts; mixing and matching of features, elements and/or acts from different embodiments; combining features, elements and/or acts from embodiments as described herein with features, elements and/or acts of other technology; and/or omitting combining features, elements and/or acts from described embodiments.

While particular elements, embodiments and applications of the present invention have been shown and described, it will be understood that the invention is not limited thereto since modifications can be made by those skilled in the art without departing from the scope of the present disclosure, particularly in light of the foregoing teachings.

What is claimed is:

1. A helical trochoidal rotary pump comprising:

an outer member having an outer member helical profile and an outer member axis; and a rotor disposed within said outer member, said rotor having a rotor helical profile and a rotor axis;

said rotor having a rotor shape at any cross-section transverse to said rotor axis that is based on a trochoidal shape, or said outer member having an outer member shape at any cross-section transverse to said outer member axis that is based on a trochoidal shape;

wherein said helical trochoidal rotary pump is configured so that during operation of said helical trochoidal rotary pump:

said rotor undergoes planetary motion relative to said outer member;

an axial load on said helical trochoidal rotary pump varies with differential pressure across said helical trochoidal rotary pump; and when a threshold differential pressure across said helical trochoidal rotary pump is reached, a corresponding axial load on said helical trochoidal rotary pump causes a change in a mechanical configuration of said helical trochoidal rotary pump.

2. The helical trochoidal rotary pump of claim 1 wherein said change in said mechanical configuration of said helical trochoidal rotary pump comprises an axial shift in position of said rotor and/or said outer member.

3. The helical trochoidal rotary pump of claim 2 wherein said axial shift in position of said rotor and/or said outer member causes a different section of said helical trochoidal rotary pump to be engaged.

4. The helical trochoidal rotary pump of claim 1 wherein said change in said mechanical configuration of said helical trochoidal rotary pump comprises a change in a gear ratio that is used to drive said helical trochoidal rotary pump.

5. The helical trochoidal rotary pump of claim 1 wherein said change in said mechanical configuration of said helical trochoidal rotary pump comprises an adjustment of a continuously variable transmission that is used to drive said helical trochoidal rotary pump.

6. The helical trochoidal rotary pump of claim 1 wherein said change in said mechanical configuration of said helical trochoidal rotary pump comprises engaging a different section of said helical trochoidal rotary pump.

7. The helical trochoidal rotary pump of claim 1 wherein:

said rotor shape is hypotrochoidal at any cross-section transverse to said rotor axis, along at least a portion of a length of said rotor, and said outer member shape at any cross-section transverse to said outer member axis along at least a portion of a length of said outer member is an outer envelope formed when said rotor shape undergoes planetary motion.

8. The helical trochoidal rotary pump of claim 7 wherein:

said rotor shape has n lobes, where n is an integer;

said outer member shape has (n−1) lobes;

the pitch of said rotor is the same as the pitch of said outer member; and the ratio of the lead of said rotor to the lead of said outer member is n:(n−1).

9. The helical trochoidal rotary pump of claim 8 wherein said rotor shape is an ellipse, and n=2.

10. The helical trochoidal rotary pump of claim 7 wherein said change in said mechanical configuration of said helical trochoidal rotary pump comprises a change in a gear ratio that is used to drive said helical trochoidal rotary pump.

11. The helical trochoidal rotary pump of claim 7 wherein said change in said mechanical configuration of said helical trochoidal rotary pump comprises an axial shift in position of said rotor and/or said outer member which causes a different section of said helical trochoidal rotary pump to be engaged.

12. The helical trochoidal rotary pump of claim 1 wherein:

said rotor shape is inwardly offset from a hypotrochoidal shape at any cross-section transverse to said rotor axis, along at least a portion of a length of said rotor, and said outer member shape at any cross-section transverse to said outer member axis along at least a portion of a length of said outer member is an outer envelope formed when said rotor shape undergoes planetary motion.

13. The helical trochoidal rotary pump of claim 12 wherein:

said rotor shape has n lobes, where n is an integer;

said outer member shape has (n−1) lobes;

the pitch of said rotor is the same as the pitch of said outer member; and the ratio of the lead of said rotor to the lead of said outer member is n:(n−1).

14. The helical trochoidal rotary pump of claim 13 wherein said hypotrochoidal shape is an ellipse, and n=2.

15. The helical trochoidal rotary pump of claim 12 wherein said change in said mechanical configuration of said helical trochoidal rotary pump comprises a change in a gear ratio that is used to drive said helical trochoidal rotary pump.

16. The helical trochoidal rotary pump of claim 12 wherein said change in said mechanical configuration of said helical trochoidal rotary pump comprises an axial shift in position of said rotor and/or said outer member which causes a different section of said helical trochoidal rotary pump to be engaged.

17. The helical trochoidal rotary pump of claim 1 wherein:

said outer member shape is an epitrochoidal shape or is outwardly offset from an epitrochoidal shape at any cross-section transverse to said outer member axis, along at least a portion of a length of said outer member, and said rotor shape at any cross-section transverse to said rotor axis, along at least a portion of a length of said rotor is an inner envelope formed when said outer member shape undergoes planetary motion.

18. A method of operating a helical trochoidal rotary pump, said helical trochoidal rotary pump comprising:

an outer member having an outer member helical profile and an outer member axis; and a rotor disposed within said outer member, said rotor having a rotor helical profile, and a rotor axis;

said rotor having a rotor shape at any cross-section transverse to said rotor axis that is based on a trochoidal shape, or said outer member having an outer member shape at any cross-section transverse to said outer member axis that is based on a trochoidal shape;

wherein said method comprises:

driving at least one of said rotor or said outer member so that said rotor undergoes planetary motion relative to said outer member, and an axial load on said helical trochoidal rotary pump varies with differential pressure across said helical trochoidal rotary pump; and using an axial load corresponding to a threshold differential pressure to cause a passive change in a mechanical configuration of said helical trochoidal rotary pump at said threshold differential pressure.

19. The method of claim 18 wherein when said threshold differential pressure is reached, said corresponding axial load causes a change in a gear ratio that is used to drive said helical trochoidal rotary pump.

20. The method of claim 18 wherein when said threshold differential pressure is reached, said corresponding axial load causes an axial shift in position of said rotor and/or said outer member which causes a different section of said helical trochoidal rotary pump to be engaged.

* * * * *